US011312917B2

(12) United States Patent
Kasai et al.

(10) Patent No.: US 11,312,917 B2
(45) Date of Patent: Apr. 26, 2022

(54) MINERAL BASE OIL, LUBRICANT COMPOSITION, INTERNAL COMBUSTION ENGINE, LUBRICATING METHOD OF INTERNAL COMBUSTION ENGINE

(71) Applicant: IDEMITSU KOSAN CO., LTD., Chiyoda-ku (JP)

(72) Inventors: Moritsugu Kasai, Chiba (JP); Norihiro Kuroda, Chiba (JP); Hisao Anzai, Kisarazu (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 161 days.

(21) Appl. No.: 16/064,806

(22) PCT Filed: Dec. 22, 2016

(86) PCT No.: PCT/JP2016/088485

§ 371 (c)(1),
(2) Date: Jun. 21, 2018

(87) PCT Pub. No.: WO2017/111081

PCT Pub. Date: Jun. 29, 2017

(65) Prior Publication Data

US 2019/0002794 A1 Jan. 3, 2019

(30) Foreign Application Priority Data

Dec. 25, 2015 (JP) ..... JP2015-255092
Dec. 19, 2016 (JP) ..... JP2016-245996

(51) Int. Cl.
*C10M 173/00* (2006.01)
*C10M 169/04* (2006.01)
(Continued)

(52) U.S. Cl.
CPC ..... *C10M 169/041* (2013.01); *C10M 101/02* (2013.01); *C10M 101/025* (2013.01);
(Continued)

(58) Field of Classification Search
CPC ..... C10M 169/041; C10M 101/02; C10M 171/02; C10M 101/025; C10M 2203/1045;
(Continued)

(56) References Cited

U.S. PATENT DOCUMENTS

2008/0110799 A1 5/2008 Matsui et al.
2008/0248981 A1 10/2008 Matsui et al.
(Continued)

FOREIGN PATENT DOCUMENTS

CN 101090960 12/2007
CN 101395256 3/2009
(Continued)

OTHER PUBLICATIONS

International Search Report dated Feb. 7, 2017, in PCT/JP2016/088485 filed Dec. 22, 2016.
(Continued)

*Primary Examiner* — Prem G Singh
*Assistant Examiner* — Francis C Campanell
(74) *Attorney, Agent, or Firm* — Oblon, McClelland, Maier & Neustadt, L.L.P.

(57) ABSTRACT

Provided is a mineral base oil satisfying the following requirements (I) to (III):

Requirement (I): a kinematic viscosity at 100° C. is 2 $mm^2/s$ or more and less than 7 $mm^2/s$;

Requirement (II): a viscosity index is 100 or more; and

Requirement (III): a temperature gradient $\Delta|\eta^*|$ of complex viscosity between two temperature points −10° C. and −25° C. is 60 Pa·s/° C. or less as measured with a
(Continued)

rotary rheometer under conditions at an angular velocity of 6.3 rad/s and a strain amount of 0.1 to 100%.

The foregoing mineral base oil can become a lubricating oil composition having desirable low-temperature viscosity characteristics, including low-temperature fuel consumption and low-temperature engine start-up performance, and also having excellent high-temperature piston detergency.

14 Claims, 2 Drawing Sheets

(51) Int. Cl.

| | |
|---|---|
| ***F01M 1/08*** | (2006.01) |
| ***C10M 101/02*** | (2006.01) |
| ***C10M 171/02*** | (2006.01) |
| *C10N 20/02* | (2006.01) |
| *C10N 30/02* | (2006.01) |
| *C10N 30/04* | (2006.01) |
| *C10N 30/00* | (2006.01) |
| *C10N 40/25* | (2006.01) |

(52) U.S. Cl.
CPC ..... *C10M 171/02* (2013.01); *F01M 1/08* (2013.01); *C10M 2203/1045* (2013.01); *C10M 2203/1065* (2013.01); *C10M 2205/022* (2013.01); *C10M 2205/163* (2013.01); *C10M 2207/262* (2013.01); *C10M 2209/084* (2013.01); *C10M 2215/28* (2013.01); *C10M 2223/045* (2013.01); *C10N 2020/02* (2013.01); *C10N 2030/02* (2013.01); *C10N 2030/04* (2013.01); *C10N 2030/43* (2020.05); *C10N 2030/68* (2020.05); *C10N 2040/25* (2013.01)

(58) Field of Classification Search
CPC ..... C10M 2205/022; C10M 2207/262; C10M 2209/084; C10M 2215/28; C10M 2223/045; C10M 2203/1065; C10M 2205/163; F01M 1/08; C10N 2020/02; C10N 2030/02; C10N 2030/04; C10N 2030/43; C10N 2030/68; C10N 2040/25
USPC ..... 508/135
See application file for complete search history.

(56) References Cited

U.S. PATENT DOCUMENTS

| | | | | |
|---|---|---|---|---|
| 2009/0075852 | A1 | 3/2009 | Yagishita et al. | |
| 2010/0041572 | A1* | 2/2010 | Sano | C10M 169/04 508/382 |
| 2010/0130395 | A1 | 5/2010 | Tagawa et al. | |
| 2010/0137176 | A1 | 6/2010 | Aoki et al. | |
| 2011/0049008 | A1 | 3/2011 | Tagawa et al. | |
| 2011/0065618 | A1 | 3/2011 | Tagawa | |
| 2011/0230685 | A1 | 9/2011 | Tagawa | |
| 2011/0237477 | A1 | 9/2011 | Tagawa et al. | |
| 2013/0281339 | A1 | 10/2013 | Kolb et al. | |
| 2019/0270943 | A1* | 9/2019 | Kasai | C10M 143/02 |

FOREIGN PATENT DOCUMENTS

| | | | |
|---|---|---|---|
| CN | 101454431 | | 6/2009 |
| CN | 101652460 | | 2/2010 |
| CN | 101978035 | | 2/2011 |
| CN | 101978036 | | 2/2011 |
| CN | 102239241 | | 11/2011 |
| CN | 102471704 | | 5/2012 |
| CN | 103396866 | | 11/2013 |
| CN | 104818081 | | 8/2015 |
| CN | 105121613 | | 12/2015 |
| EP | 2 341 122 | A1 | 7/2011 |
| EP | 2 439 258 | A1 | 4/2012 |
| EP | 2 905 323 | A1 | 8/2015 |
| JP | S50-92303 | | 7/1975 |
| JP | 4-136096 | A | 5/1992 |
| JP | 2005-154760 | A | 6/2005 |
| JP | 2006-241436 | A | 9/2006 |
| JP | 2006-521416 | A | 9/2006 |
| JP | 2007-16172 | A | 1/2007 |
| JP | 2007-254559 | A | 10/2007 |
| JP | 2008-274237 | A | 11/2008 |
| JP | 2009-227941 | A | 10/2009 |
| JP | 2010-90251 | A | 4/2010 |
| JP | 2010-90254 | A | 4/2010 |
| JP | 2010-90257 | A | 4/2010 |
| JP | 2012-144715 | A | 8/2012 |
| JP | 2012-153906 | A | 8/2012 |
| JP | 2012-525471 | A | 10/2012 |
| JP | 2013-539480 | A | 10/2013 |
| WO | WO 2008/123246 | A1 | 10/2008 |
| WO | WO 2008/123249 | A1 | 10/2008 |
| WO | WO 2009/119506 | A1 | 1/2009 |
| WO | WO 2009/051072 | A1 | 4/2009 |
| WO | WO 2009/119505 | A1 | 10/2009 |
| WO | WO 2009/119506 | A1 | 10/2009 |
| WO | WO 2010/041591 | A1 | 4/2010 |
| WO | WO 2010/041689 | A1 | 4/2010 |
| WO | WO 2010/041889 | A1 | 4/2010 |
| WO | WO 2010/140562 | A1 | 12/2010 |
| WO | WO 2014/136643 | A1 | 9/2014 |

OTHER PUBLICATIONS

Extended European Search Report dated Jul. 11, 2019 in European Patent Application No. 16878967.5, 10 pages.
Office Action dated Apr. 12, 2016 in Japanese Patent Application No. 2015-255092, 10 pages (with unedited computer generated English translation).
Office Action in CN Application No. 201680075614.3, dated Jan. 21, 2021, w/ English translation 43 pages.
Han Chongren, "Hydrocracking Technology and Engineering", China Petrochemical Press, pp. 889-897, Jul. 31, 2001.
Office Action dated Dec. 1, 2020 in corresponding Japanese Patent Application No. 2016-245996 (with English Translation), 10 pages.
Chinese Office Action dated Sep. 14, 2021 in Chinese Patent Application No. 201680075614.3, 11 pages.

* cited by examiner

[Fig. 1]
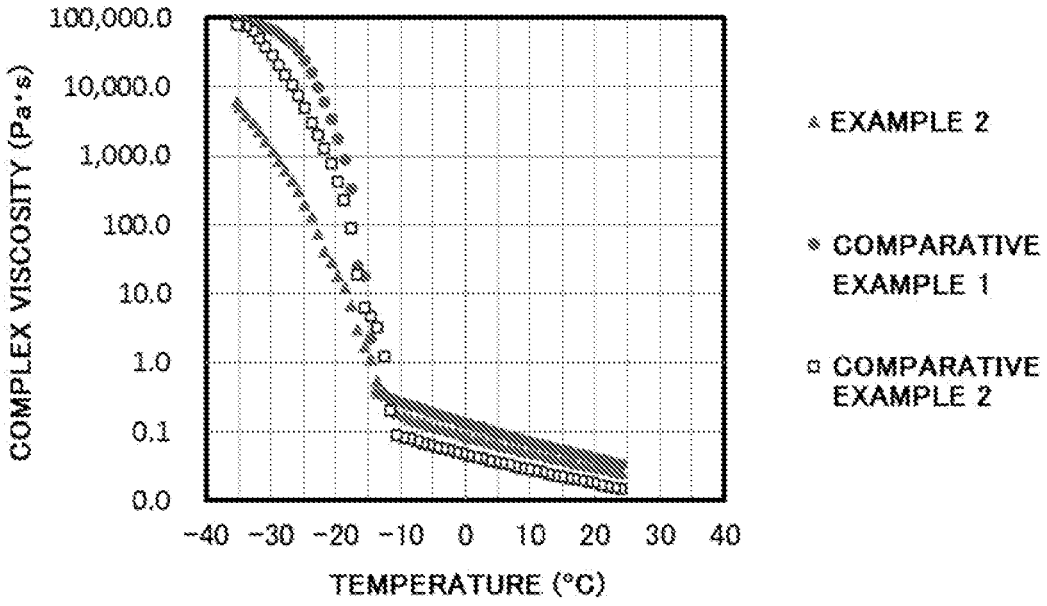

[Fig. 2]
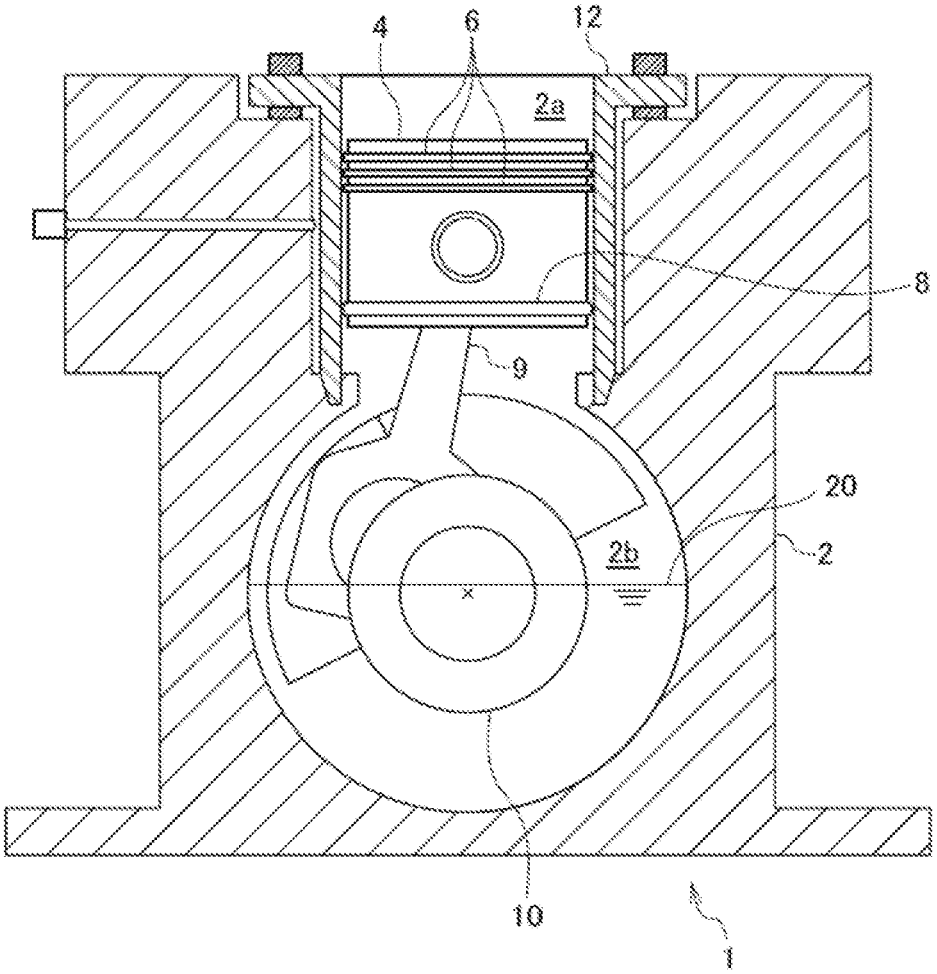

MINERAL BASE OIL, LUBRICANT COMPOSITION, INTERNAL COMBUSTION ENGINE, LUBRICATING METHOD OF INTERNAL COMBUSTION ENGINE

TECHNICAL FIELD

The present invention relates to a mineral base oil, a lubricating oil composition including the mineral base oil, an internal combustion engine using the lubricating oil composition, and a method for lubricating an internal combustion engine with the lubricating oil composition.

BACKGROUND ART

Recent years, hybrid vehicles and vehicles equipped with a start-stop mechanism have increased. These vehicles provide an environment where the temperature of the engine oil cannot be easily increased. The engine oils used for these vehicles are thus particularly required to further improve low-temperature viscosity characteristics such that fuel consumption and engine start-up performance at a further low temperature are improved.

In addition to such low-temperature viscosity characteristics, the engine oils are also required to have other desirable properties, including a viscosity-temperature characteristic, and low evaporativity.

In order to provide an engine oil having a good balance of these and other properties, there has been active development of a base oil for a lubricating oil that can be used as an engine oil capable of meeting the required engine oil performance. PTLs 1 to 4 disclose base oils for a lubricating oil which have the specific physical property values adjusted within predetermined ranges.

CITATION LIST

Patent Literature

PTL 1: JP 2008-274237 A
PTL 2: JP 2012-153906 A
PTL 3: JP 2007-016172 A
PTL 4: JP 2006-241436 A

SUMMARY OF INVENTION

Technical Problem

Typically, the low-temperature viscosity characteristics of an engine oil are improved by mixing a polymer component as a pour-point depressant or a viscosity index improver, with a base oil for a lubricating oil.

However, the presence of such a polymer component to be mixed as a pour-point depressant or a viscosity index improver becomes a factor that lowers the high-temperature piston detergency of the engine oil.

Engine oils using the lubricant base oils described in PTLs 1 to 4 involve problems in high-temperature piston detergency and also have room for a more improvement in the low-temperature viscosity characteristics.

Accordingly, there is a need for a lubricating oil composition that can be used as an engine oil having improved low-temperature viscosity characteristics and high-temperature piston detergency in a good balance.

An object of the present invention is to provide a mineral base oil that can be used as an engine oil having desirable low-temperature viscosity characteristics, including low-temperature fuel consumption and low-temperature engine start-up performance, and also having excellent high-temperature piston detergency, a lubricating oil composition using the mineral base oil, an internal combustion engine using the lubricating oil composition, and a method for lubricating an internal combustion engine with the lubricating oil composition.

Solution to Problem

The present inventors found that the foregoing problems can be solved with a mineral base oil that has a predetermined kinematic viscosity and a predetermined viscosity index, and a temperature gradient $\Delta|\eta^*|$ of complex viscosity between two temperature points −10° C. and −25° C. which is adjusted to a predetermined value or less.

The present invention has been accomplished on the basis of this finding.

Specifically, the present invention provides the following [1] to [4].

[1] A mineral base oil satisfying the following requirements (I) to (III):

Requirement (I): a kinematic viscosity at 100° C. is 2 $mm^2/s$ or more and less than 7 $mm^2/s$;

Requirement (II): a viscosity index is 100 or more; and

Requirement (III): a temperature gradient $\Delta|\eta^*|$ of complex viscosity between two temperature points −10° C. and −25° C. is 60 Pa·s/° C. or less as measured with a rotary rheometer under conditions at an angular velocity of 6.3 rad/s and a strain amount of 0.1 to 100%.

[2] A lubricating oil composition containing a mineral base oil satisfying the following requirements (I) to (III) and an olefinic copolymer:

Requirement (I): a kinematic viscosity at 100° C. is 2 $mm^2/s$ or more and less than 7 $mm^2/s$;

Requirement (II): a viscosity index is 100 or more; and

Requirement (III): a temperature gradient $\Delta|\eta^*|$ of complex viscosity between two temperature points −10° C. and −25° C. is 60 Pa·s/° C. or less as measured with a rotary rheometer under conditions at an angular velocity of 6.3 rad/s and a strain amount of 0.1 to 100%.

[3] An internal combustion engine including a sliding mechanism equipped with a piston ring and a liner, and the lubricating oil composition as set forth in the above [2].

[4] A method for lubricating an internal combustion engine having a sliding mechanism equipped with a piston ring and a liner, the method including lubricating the piston ring and the liner with the lubricating oil composition as set forth in the above [2].

Advantageous Effects of Invention

A lubricating oil composition having desirable low-temperature viscosity characteristics, including low-temperature fuel consumption and low-temperature engine start-up performance, and also having excellent high-temperature piston detergency can be easily prepared by using the mineral base oil according to the present invention.

BRIEF DESCRIPTION OF DRAWINGS

FIG. 1 is a graph representing the relationship between temperature and complex viscosity $\eta^*$ with respect to the mineral base oil (2) of Example 2, the mineral base oil (a) of Comparative Example 1, and the mineral base oil (b) of Comparative Example 2.

FIG. 2 is a schematic view illustrating an outline of a configuration of a sliding mechanism equipped with a piston ring and a liner.

DESCRIPTION OF EMBODIMENTS

In this specification, the values of kinematic viscosity and viscosity index at predetermined temperatures are values measured in conformity with JIS K2283:2000.

In this specification, the value of the complex viscosity $\eta^*$ at a predetermined temperature is a value measured with a rotary rheometer under conditions at an angular velocity of 6.3 rad/s and a strain amount of 0.1 to 100%, and more specifically, means a value measured according to the method described in the section of Examples. The aforementioned "strain amount" is a measurement condition parameter that is appropriately set within a range of from 0.1 to 100% according to the measurement temperature.

In this specification, the values of the weight-average molecular weight (Mw) and the number average molecular weight (Mn) of the respective component are each a value expressed in terms of standard polystyrene as measured by the gel permeation chromatography (GPC), specifically, a value measured according to the method described in the section of Examples.

In this specification, the CCS viscosity (low-temperature viscosity) at −35° C. is a value measured in conformity with JIS K2010:1993 (ASTM D2602).

[Mineral Base Oil]

Examples of the mineral base oil of the present invention include an atmospheric residue obtained by atmospheric distillation of a crude oil, such as a paraffinic mineral oil, an intermediate mineral oil, a naphthenic mineral oil, etc.; a distillate oil obtained by vacuum distillation of the atmospheric residue; a mineral oil or a wax (e.g., GTL wax) obtained by subjecting the distillate oil to at least one purification process, such as solvent deasphalting, solvent extraction, hydrofinishing, solvent dewaxing, catalytic dewaxing, isomerization dewaxing, vacuum distillation, etc.; and the like.

These mineral oils may be used either alone or in combination of two or more thereof.

The mineral base oil of the present invention satisfies the following requirements (I) to (III).

Requirement (I): a kinematic viscosity at 100° C. is 2 $mm^2/s$ or more and less than 7 $mm^2/s$.

Requirement (II): a viscosity index is 100 or more.

Requirement (III): a temperature gradient $\Delta|\eta^*|$ of complex viscosity between two temperature points −10° C. and −25° C. is 60 Pa·s/° C. or less as measured with a rotary rheometer under conditions at an angular velocity of 6.3 rad/s and a strain amount of 0.1 to 100%.

In addition, it is preferred that the mineral base oil of one embodiment of the present invention further satisfies the following requirement (IV).

Requirement (IV): complex viscosity $\eta^*$ at −35° C. is 60,000 Pa·s or less as measured with a rotary rheometer under conditions at an angular velocity of 6.3 rad/s and a strain amount of 0.1%.

In the case where the mineral base oil of one embodiment of the present invention is a mixed oil of two or more mineral oils, it is enough that the mixed oil satisfies the aforementioned requirements.

The requirements (I) to (IV) are hereunder described.

<Requirement (I)>

The requirement (I) is one prescribing the balance between the evaporation loss and the fuel economy improving effect of the mineral base oil.

Namely, when the kinematic viscosity at 100° C. of the mineral base oil of the present invention is less than 2 $mm^2/s$, the evaporation loss increases, and hence, such is not preferred. On the other hand, when the kinematic viscosity at 100° C. is 7 $mm^2/s$ or more, the power loss to be caused due to viscosity resistance increases, and hence, such is problematic in terms of a fuel economy improving effect.

From the viewpoint of reducing the evaporation loss of the mineral base oil, the kinematic viscosity at 00° C. of the mineral base oil of one embodiment of the present invention is preferably 2.1 $mm^2/s$ or more, more preferably 2.2 $mm^2/s$ or more, and still more preferably 2.5 $mm^2/s$ or more, and from the viewpoint of improving the fuel economy improving effect of the mineral base oil, it is preferably 6 $mm^2/s$ or less, more preferably 5.5 $mm^2/s$ or less, still more preferably 5 $mm^2/s$ or less, and yet still more preferably 4.7 $mm^2/s$ or less.

<Requirement (II)>

The requirement (II) is a prescription for producing a mineral base oil with a desirable viscosity-temperature characteristic and desirable fuel consumption.

Namely, when the viscosity index of the mineral base oil of the present invention is less than 100, the viscosity-temperature characteristic and fuel consumption notably decrease, and a lubricating oil composition using the mineral base oil becomes problematic in terms of a fuel consumption performance.

From the foregoing viewpoint, the viscosity index of the mineral base oil of one embodiment of the present invention is preferably 105 or more, and more preferably 110 or more.

The mineral base oil of the present invention satisfies the requirement (III) as described later, and therefore, even when its viscosity index is not relatively high, a lubricating oil composition having desirable low-temperature viscosity characteristics, including low-temperature fuel consumption and low-temperature engine start-up performance can be provided.

Accordingly, the viscosity index of the mineral base oil of one embodiment of the present invention is preferably 145 or less, more preferably 140 or less, still more preferably 135 or less, and yet still more preferably less than 130.

<Requirement (III)>

As prescribed by the requirement (III), the mineral base oil of the present invention requires that the temperature gradient $\Delta|\eta^*|$ of complex viscosity between two temperature points −10° C. and −25° C. (hereinafter also referred to simply as "temperature gradient $\Delta|\eta^*|$ of complex viscosity", unless otherwise specified) is 60 Pa·s/PC or less as measured with a rotary rheometer under conditions at an angular velocity of 6.3 rad/s and a strain amount of 0.1 to 100%.

The value of the aforementioned "strain amount" in the requirement (III) is appropriately set within a range of from 0.1 to 100% according to the temperature.

The aforementioned "temperature gradient $\Delta|\eta^*|$ of complex viscosity" is a value indicative of an amount of change (absolute value of a slope) of complex viscosity per unit between two temperature points −10° C. and −25° C. as observed when the value of the complex viscosity $\eta^*$ at −10° C. and the value of the complex viscosity $\eta^*$ at −25° C. as measured either independently at these temperatures or while continuously varying the temperature from −10° C. to −25° C. or from −25° C. to −10° C. are placed on a temperature-complex viscosity coordinate plane. More specifically, the temperature gradient $\Delta|\eta^*|$ of complex viscosity means a value calculated from the following calculation formula (f1).

Temperature gradient $\Delta|\eta^*|$ of complex viscosity=|([complex viscosity $\eta^*$ at −25° C.]−[complex viscosity $\eta^*$ at −10° C.])/(−25−(−10))| Calculation formula (f1):

The present inventors have found that by associating the complex viscosity of the mineral base oil with the temperature, effects that low-temperature viscosity characteristics, including low-temperature fuel consumption and low-temperature engine start-up performance, and piston detergency are excellent are obtained; and that the relationship between complex viscosity and temperature is greatly influenced by the components, the composition, the state, the manufacturing conditions, and so on of the mineral base oil.

FIG. 1 is a graph representing the relationship between temperature and complex viscosity $\eta^*$ with respect to the mineral base oil (2) of Example 2, the mineral base oil (a) of Comparative Example 1, and the mineral base oil (b) of Comparative Example 2, as described later.

The "temperature gradient $\Delta|\eta^*|$ of complex viscosity" as referred to herein is the amount of change of complex viscosity over a temperature range of from −25° C. to −10° C., namely the slope of the graph shown in FIG. 1.

In general, as one of evaluation indexes of low-temperature viscosity characteristics, a "pour point" that is a temperature just before the mineral base oil solidifies is used.

The present inventors have found that the temperature at which the complex viscosity rapidly increases is substantially coincident with the "pour point"; and that even in mineral oils having a closely resembling "pour point" to each other, as shown in the graph of FIG. 1, the mineral oils differently exhibit increases or decreases of the complex viscosity in a low-temperature environment below the pour point.

On the basis of these findings, the present inventors have envisaged that it might be possible to obtain a mineral base oil with improved low-temperature viscosity characteristics when a specified relationship is considered between the complex viscosity of the mineral base oil and the temperature in a low-temperature environment below the pour point, thereby leading to accomplishment of the present invention.

Other typical evaluation methods of low-temperature viscosity characteristics use values of various viscosities, such as CCS viscosity, BF viscosity, etc. However, these evaluation methods do not necessarily accurately specify the low-temperature viscosity characteristics of a mineral base oil in a low-temperature environment.

Namely, a mineral base oil contains a wax, and the oil forms a gelatinous structure as the wax component precipitates in a low-temperature environment below the pour point. The gelatinous structure easily breaks, and the viscosity changes under a mechanical action. Accordingly, the CCS viscosity used to evaluate the low-temperature viscosity characteristics is thus merely a low-temperature apparent viscosity under predetermined conditions, and does not represent a physical property that sufficiently represents the viscosity characteristics in a low-temperature environment.

In addition to the above, for example, in a mineral base oil obtained by refining a feedstock oil containing a bottom oil, for example, on measuring the BF viscosity or the like, it occasionally gives influences, such as the matter that the measured value is liable to become instable, etc., and there is a case where the low-temperature viscosity characteristics cannot be accurately evaluated.

Then, the present inventors made various extensive and intensive investigations. As a result, it has been found that by focusing on the aforementioned "temperature gradient $\Delta|\eta^*|$ of complex viscosity", a mineral base oil with improved low-temperature viscosity characteristics can be obtained by considering the changes in coefficient of friction following the precipitation of the wax component, while taking into account the precipitation rate of the wax component contained in the mineral base oil, which cannot be grasped with CCS viscosity, BF viscosity, and so on, thereby leading to accomplishment of the present invention.

In accordance with the investigations made by the present inventors, a mineral base oil having the temperature gradient $\Delta|\eta^*|$ of complex viscosity exceeding 60 Pa·s/° C. involves a high wax precipitation rate, and is liable to cause an increase of coefficient of friction. As a result, it has been found that a lubricating oil composition using the foregoing mineral base oil has a poor fuel saving performance in a low-temperature environment.

Furthermore, the present inventors have also found that a lubricating oil composition (engine oil) with greatly improved high-temperature piston detergency can be prepared by using a mineral base oil having a small temperature gradient $\Delta|\eta^*|$ of complex viscosity.

Namely, it has been noted that a lubricating oil composition using a mineral base oil having a temperature gradient $\Delta|\eta^*|$ of complex viscosity of 60 Pa·s/° C. or less can have desirable high-temperature piston detergency, as shown in the section of Examples as described later. In addition, such a lubricating oil composition produces only a few deposits and can have desirable piston detergency even when a polymer component, such as a pour-point depressant, etc., that may cause deposit production, is added together with the mineral base oil having a temperature gradient $\Delta|\eta^*|$ of complex viscosity of 60 Pas/PC or less.

In the mineral base oil of one embodiment of the present invention, from the aforementioned viewpoints, the temperature gradient $\Delta|\eta^*|$ of complex viscosity as prescribed by the requirement (III) is preferably 50 Pa·s/° C. or less, more preferably 20 Pa·s/° C. or less, still more preferably 15 Pa·s/° C. or less, yet still more preferably 10 Pa·s/° C. or less, and especially preferably 5 Pa·s/° C. or less.

In the mineral base oil of one embodiment of the present invention, though a lower limit value of the temperature gradient $\Delta|\eta^*|$ of complex viscosity as prescribed by the requirement (III) is not particularly limited, it is preferably 0.001 Pa·s/° C. or more, more preferably 0.01 Pa·s/° C. or more, and still more preferably 0.02 Pa·s/° C. or more.

<Requirement (IV)>

The requirement (IV) is one of indexes that represent the low-temperature viscosity characteristics of the mineral base oil in a low-temperature environment, independently from the requirement (III).

A mineral base oil with a low complex viscosity $\eta^*$ at −35° C. as prescribed by the requirement (IV) tends to have a low paraffin content. Accordingly, by using such a mineral base oil, a lubricating oil composition having desirable low-temperature viscosity characteristics, including low-temperature fuel consumption and low-temperature engine start-up performance, and improved high-temperature piston detergency can be produced.

In the mineral base oil of one embodiment of the present invention, from the aforementioned viewpoints, the complex viscosity $\eta^*$ at −35° C. as prescribed by the requirement (IV) is preferably 60,000 Pas/° C. or less, more preferably 40,000 Pa·s/° C. or less, still more preferably 10,000 Pa·s/° C. or less, still more preferably 6,000 Pa·s/° C. or less, yet still more preferably 2,000 Pas/° C. or less, and especially preferably 600 Pa·s/° C. or less.

Though a lower limit value of the complex viscosity η* at −36° C. as prescribed by the requirement (IV) is not particularly limited, it is preferably 0.1 Pas/° C. or more, more preferably 1 Pa·s/° C. or more, and still more preferably 2 Pa·s/° C. or more.

The naphthene content (% $C_N$) of the mineral base oil of one embodiment of the present invention is preferably 10 to 30, more preferably 13 to 30, still more preferably 15 to 30, yet still more preferably 16 to 30, and even yet still more preferably 20 to 30.

The naphthene content contained in a mineral base oil is generally known to cause a lowering of the viscosity index. Mineral base oils used for engine oils require desirable viscosity characteristics over a wide temperature range, and therefore, those having a low naphthene content are considered to be suitable.

However, the mineral base oil of the present invention satisfies particularly the requirement (III), and therefore, it has desirable low-temperature viscosity characteristics and may sufficiently suppress a lowering of the viscosity characteristics to be caused due to the naphthene component.

Furthermore, by using a mineral base oil having a high naphthene content, a lubricating oil composition with more improved high-temperature piston detergency can also be produced.

From the viewpoint of producing a mineral base oil capable of producing a lubricating oil composition that is excellent in the high-temperature piston detergency, the aromatic content (% $C_A$) of the mineral base oil of one embodiment of the present invention is preferably less than 1.0, and more preferably 0.1 or less.

In this specification, the naphthene content (% $C_N$) and the aromatic content (% $C_A$) of the mineral base oil each mean the proportion (percentage) of the naphthene or aromatic component as measured using the ASTM D-3238 ring analysis (n-d-M method).

From the viewpoint of producing a mineral base oil capable of producing a lubricating oil composition that is excellent in the high-temperature piston detergency, the sulfur content of the mineral base oil of one embodiment of the present invention is preferably less than 500 ppm by mass, and more preferably less than 100 ppm by mass.

In this specification, the sulfur content of the mineral base oil is a value measured in conformity with the "Crude Oil and Petroleum Product—Sulfur Content Testing Method" of JIS K2541-6:2003.

From the viewpoint of producing a mineral base oil capable of producing a lubricating oil composition that is excellent in the high-temperature piston detergency, it is preferred that the mineral base oil of one embodiment of the present invention has an aromatic content (% $C_A$) of 0.1 or less and a sulfur content of less than 100 ppm by mass.

<Preparation Example of Mineral Base Oil Satisfying Requirements (I) to (IV)>

The mineral base oil satisfying the requirements (I) to (IV), particularly the requirements (III) and (IV) can be easily prepared by appropriately considering, for example, the following matters. The following matters merely represent an example of the preparation method, and it is also possible to prepare the mineral base oil by considering matters different from the foregoing matters.

(1) Adjustment of Weight-Average Molecular Weight of Mineral Base Oil

The weight-average molecular weight (Mw) of the mineral base oil is a physical property that affects the properties as prescribed by the requirements (I) to (IV) (particularly, the properties as prescribed by the requirements (III) and (IV)).

From the viewpoint of producing a mineral base oil satisfying the requirements (I) to (IV), particularly the requirements (I), (III), and (IV), a weight-average molecular weight (Mw) of the mineral base oil of one embodiment of the present invention is preferably 450 or less, and it is preferably 150 or more.

(2) Selection of Feedstock Oil as Feedstock of Mineral Base Oil

The mineral base oil of one embodiment of the present invention is preferably one obtained by purifying a feedstock oil.

From the viewpoint of producing a mineral base oil satisfying the requirements (I) to (IV), particularly the requirements (III) and (IV), the feedstock oil is preferably a feedstock oil containing a petroleum-derived wax, or a feedstock oil containing a petroleum-derived wax and a bottom oil. In addition, a feedstock oil containing a solvent dewaxed oil may also be used.

In the case of using a feedstock oil containing a petroleum-derived wax and a bottom oil, from the viewpoint of producing a mineral base oil satisfying the requirements (III) and (IV), a content ratio of the wax and the bottom oil [wax/bottom oil] in the feedstock oil is preferably 30/70 to 95/5, more preferably 55/45 to 95/5, still more preferably 70/30 to 95/5, and yet still more preferably 80/20 to 95/5 in terms of a mass ratio.

As the proportion of the bottom oil in the feedstock oil increases, the value of the temperature gradient Δ|η*| of complex viscosity as prescribed by requirement (III) tends to increase, and the value of the complex viscosity η* at −35° C. as prescribed by the requirement (IV) is also liable to increase.

On the other hand, the bottom oil contains a lot of the naphthene component, and therefore, a mineral base oil of a high naphthene content (% $C_N$) can be prepared by using a feedstock oil containing a bottom oil, and this contributes to the high-temperature piston detergency of the lubricating oil composition.

As the bottom oil, there is exemplified a bottom fraction remained after hydrocracking of a heavy fuel oil obtained from a vacuum distillation unit in a common fuel oil producing process using a crude oil as a feedstock, followed by separation and removal of naphtha and a kerosene-gas oil.

Examples of the wax include, in addition to waxes to be separated after solvent dewaxing of the aforementioned bottom fraction, waxes obtained after solvent dewaxing of an atmospheric residue remained after atmospheric distillation of a crude oil, such as a paraffinic mineral oil, an intermediate mineral oil, a naphthenic mineral oil, etc., followed by separation and removal of naphtha and a gas oil; waxes obtained after solvent dewaxing of a distillate oil obtained through vacuum distillation of the atmospheric residue; waxes obtained after solvent dewaxing of the distillate oil having been subjected to solvent deasphalting, solvent extraction, or hydrofinishing; GTL waxes obtained through the Fischer-Tropsch synthesis; and the like.

On the other hand, as the solvent dewaxed oil, there is exemplified a residue after solvent dewaxing of the aforementioned bottom fraction or the like, followed by separation and removal of the aforementioned wax. In addition, the solvent dewaxed oil is one having been subjected to a purification process by solvent dewaxing and is different from the aforementioned bottom oil.

The method for obtaining a wax through solvent dewaxing is preferably a method in which, for example, the bottom fraction is mixed with a mixed solvent of methyl ethyl ketone and toluene, and the precipitate is removed while agitating the mixture in a low temperature region.

From the viewpoint of producing a mineral base oil satisfying the requirements (II) and (IV), a specific temperature in the solvent dewaxing in a low-temperature environment is preferably lower than the typical solvent dewaxing temperature. Specifically, the temperature is preferably −25° C. or lower, and more preferably −30° C. or lower.

From the viewpoint of producing a mineral base oil satisfying the requirements (III) and (IV), the oil content of the feedstock oil is preferably 6 to 55% by mass, more preferably 7 to 45% by mass, still more preferably 10 to 35% by mass, yet still more preferably 16 to 32% by mass, and especially preferably 21 to 30% by mass.

From the viewpoint of producing a mineral base oil satisfying the requirement (I), the kinematic viscosity at 100° C. of the feedstock oil is preferably 2.0 to 7.0 $mm^2/s$, more preferably 2.3 to 6.5 $mm^2/s$, and still more preferably 2.5 to 6.0 $mm^2/s$.

From the viewpoint of producing a mineral base oil satisfying the requirement (II), the viscosity index of the feedstock oil is preferably 100 or more, more preferably 110 or more, and still more preferably 120 or more.

(3) Setting of Purification Conditions for Feedstock Oil

Preferably, the feedstock oil is subjected to a purification process to prepare a mineral base oil satisfying the requirements (I) to (IV).

Preferably, the purification process includes at least one of a hydrogenation isomerization dewaxing process and a hydrogenation process. Preferably, the type of the purification process and the purification conditions are appropriately set according to the kind of the feedstock oil to be used.

More specifically, from the viewpoint of producing a mineral base oil satisfying the requirements (III) and (IV), it is preferred to select a purification process according to the kind of the feedstock oil to be used in the following manner.

In the case of using a feedstock oil (α) containing a petroleum-derived wax and a bottom oil in the foregoing content ratio, it is preferred that the feedstock oil (α) is subjected to a purification process including both a hydrogenation isomerization dewaxing process and a hydrogenation process.

In the case of using a feedstock oil (β) containing a solvent dewaxed oil, it is preferred that the feedstock oil (β) is subjected to a purification process including a hydrogenation process without performing a hydrogenation isomerization dewaxing process.

The feedstock oil (a) contains a bottom oil, and therefore, the contents of aromatic, sulfur, and nitrogen components tend to increase. The presence of the aromatic, sulfur, and nitrogen components becomes a factor that generates a deposit in a lubricating oil composition and causes a lowering of the high-temperature piston detergency performance.

By performing the hydrogenation isomerization dewaxing process, it is possible to contemplate to remove the aromatic, sulfur, and nitrogen components, thereby reducing the contents of these components.

According to the hydrogenation isomerization dewaxing process, the straight-chain paraffin in the wax is converted into a branched-chain isoparaffin, whereby a mineral base oil satisfying the requirements (III) and (IV) can be produced.

On the other hand, though the feedstock oil (J) contains a wax, the straight-chain paraffin is separated and removed through precipitation in a low-temperature environment in a solvent dewaxing process, and therefore, the content of the straight-chain paraffin that affects the value of the complex viscosity value as prescribed by the requirements (III) and (IV) is small. Accordingly, there is less need to perform the "hydrogenation isomerization dewaxing process".

(Hydrogenation Isomerization Dewaxing Process)

The hydrogenation isomerization dewaxing process is a purification process that is performed for purposes of isomerizing the straight-chain paraffin contained in the feedstock oil into a branched-chain isoparaffin, ring-opening the aromatic component to transform it into a paraffin component, and removing the sulfur and nitrogen components and other impurities, and so on, as described above. In particular, the presence of the straight-chain paraffin is one of factors that increase the value of the temperature gradient $\Delta|\eta^*|$ of complex viscosity prescribed by requirement (III). Therefore, according to this process, the value of the temperature gradient $\Delta|\eta^*|$ of complex viscosity is adjusted low through isomerization of the straight-chain paraffin into a branched-chain isoparaffin.

Preferably, the hydrogenation isomerization dewaxing process is performed in the presence of a hydrogenation isomerization dewaxing catalyst. Examples of the hydrogenation isomerization dewaxing catalyst include catalysts with a metal oxide of nickel (Ni)/tungsten (W), nickel (Ni)/molybdenum (Mo), cobalt (Co)/molybdenum (Mo), etc., or a noble metal, such as platinum (Pt), lead (Pd), etc., supported on a carrier, such as silicoaluminophosphate (SAPO), zeolite, etc.

From the viewpoint of producing a mineral base oil satisfying the requirements (III) and (IV), a hydrogen partial pressure in the hydrogenation isomerization dewaxing process is preferably 2.0 to 220 MPa, more preferably 2.5 to 100 MPa, still more preferably 3.0 to 50 MPa, and yet still more preferably 3.5 to 25 MPa.

From the viewpoint of producing a mineral base oil satisfying the requirements (III) and (IV), a reaction temperature in the hydrogenation isomerization dewaxing process is preferably set to a temperature higher than the reaction temperature of a common hydrogenation isomerization dewaxing process, and specifically, it is preferably 320 to 480° C., more preferably 325 to 420° C., still more preferably 330 to 400° C., and yet still more preferably 335 to 370° C.

When the reaction temperature is a high temperature, the isomerization of the straight-chain paraffin existent in the feedstock oil into a branched-chain isoparaffin can be promoted, whereby it becomes easy to prepare a mineral base oil satisfying the requirements (II) and (IV).

From the viewpoint of producing a mineral base oil satisfying the requirements (III) and (IV), a liquid hourly space velocity (LHSV) in the hydrogenation isomerization dewaxing process is preferably 5.0 $hr^{-1}$ or less, more preferably 2.0 $hr^{-1}$ or less, still more preferably 1.0 $hr^{-1}$ or less, and yet still more preferably 0.6 $hr^{-1}$ or less.

From the viewpoint of improving the productivity, the LHSV in the hydrogenation isomerization dewaxing process is preferably 0.1 $hr^{-1}$ or more, and more preferably 0.2 $hr^{-1}$ or more.

A supply proportion of the hydrogen gas in the hydrogenation isomerization dewaxing process is preferably 100 to 1,000 Nm, more preferably 200 to 800 $Nm^3$, and still more preferably 250 to 650 $Nm^3$ per kiloliter of the feedstock oil to be supplied.

The generated oil after the hydrogenation isomerization dewaxing process may be subjected to vacuum distillation for the purpose of removing the light fraction.

(Hydrogenation Process)

The hydrogenation process is a purification process that is performed for purposes of complete saturation of the aromatic component contained in the feedstock oil, removal of impurities, such as the sulfur component, the nitrogen component, etc., and so on.

Preferably, the hydrogenation process is performed in the presence of a hydrogenation catalyst.

Examples of the hydrogenation catalyst include catalysts with a metal oxide of nickel (Ni)/tungsten (W), nickel (Ni)/molybdenum (Mo), cobalt (Co)/molybdenum (Mo), etc., or a noble metal, such as platinum (Pt), lead (Pd), etc., supported on an amorphous carrier, such as silica/alumina, alumina, etc., or a crystalline carrier, such as zeolite, etc.

From the viewpoint of producing a mineral base oil satisfying the requirements (III) and (IV), a hydrogen partial pressure in the hydrogenation process is preferably set to a pressure higher than the pressure of a common hydrogenation process, and specifically, it is preferably 16 MPa or more, more preferably 17 MPa or more, and still more preferably 20 MPa or more, and it is preferably 30 MPa or less, and more preferably 22 MPa or less.

From the viewpoint of producing a mineral base oil satisfying the requirements (III) and (IV), a reaction temperature in the hydrogenation process is preferably 200 to 400° C., more preferably 250 to 350° C., and still more preferably 280 to 330° C.

From the viewpoint of producing a mineral base oil satisfying the requirements (III) and (IV), a liquid hourly space velocity (LHSV) in the hydrogenation process is preferably 5.0 $hr^{-1}$ or less, more preferably 2.0 $hr^{-1}$ or less, and still more preferably 1.0 $hr^{-1}$ or less, and from the viewpoint of productivity, it is preferably 0.1 $hr^{-1}$ or more, more preferably 0.2 $hr^{-1}$ or more, and still more preferably 0.3 $hr^{-1}$ or more.

A supply proportion of the hydrogen gas in the hydrogenation process is preferably 100 to 1,000 $Nm^3$, more preferably 200 to 800 $Nm^3$, and still more preferably 250 to 660 $Nm^3$ per kiloliter of the supplied oil as a processing object.

The generated oil after the hydrogenation process may be subjected to vacuum distillation for the purpose of removing the light fraction. Various conditions of the vacuum distillation (e.g., pressure, temperature, time, etc.) are appropriately adjusted so as to make the kinematic viscosity at 100° C. of the mineral base oil fall within a desirable range.

<Various Physical Properties of Mineral Base Oil>

A CCS viscosity (low-temperature viscosity) at −35° C. of the mineral base oil to be used in one embodiment of the present invention is preferably 5,000 mPa·s or less, more preferably 4,000 mPa·s or less, still more preferably 3,000 mPa·s or less, and yet still more preferably 2,500 mPa·s or less.

[Lubricating Oil Composition]

The lubricating oil composition of the present invention is one containing a mineral base oil that satisfies the following requirements (I) to (III) and an olefinic copolymer.

Requirement (I): a kinematic viscosity at 100° C. is 2 $mm^2/s$ or more and less than 7 $mm^2/s$.

Requirement (II): a viscosity index is 100 or more.

Requirement (III): a temperature gradient $\Delta|\eta^*|$ of complex viscosity between two temperature points −10° C. and −25° C. is 60 Pa·s/° C. or less as measured with a rotary rheometer under conditions at an angular velocity of 6.3 rad/s and a strain amount of 0.1 to 100%.

The "mineral base oil satisfying the aforementioned requirements (I) to (III)" to be contained in the lubricating oil composition of the present invention is identical with the aforementioned "mineral base oil of the present invention".

Accordingly, suitable embodiment, preparation method, suitable ranges of various properties, and so on of the mineral base oil to be contained in the lubricating oil composition of the present invention are the same as those in the aforementioned "mineral base oil of the present invention".

Though the lubricating oil composition of the present invention contains the mineral base oil and the olefinic copolymer, it may further contain an additive for a lubricating oil other than a synthetic oil and an olefinic copolymer within a range where the effects of the present invention are not impaired.

In addition, the lubricating oil composition of one embodiment of the present invention may contain a synthetic oil together with the aforementioned mineral base oil within a range where the effects of the present invention are not impaired.

Examples of the synthetic oil include a poly-α-olefin (PAO), an ester-based compound, an ether-based compound, a polyglycol, an alkylbenzene, an alkylnaphthalene, and the like.

These synthetic oils may be used either alone or in combination of two or more thereof.

The content of the synthetic oil in the lubricating oil composition of one embodiment of the present invention is preferably 0 to 30 parts by mass, more preferably 0 to 20 parts by mass, still more preferably 0 to 15 parts by mass, yet still more preferably 0 to 10 parts by mass, and especially preferably 0 to 5 parts by mass based on 100 parts by mass of the whole amount of the mineral base oil in the lubricating oil composition.

In the lubricating oil composition of one embodiment of the present invention, a total content of the mineral base oil and the olefinic copolymer is preferably 60% by mass or more, more preferably 65% by mass or more, still more preferably 70% by mass or more, and yet still more preferably 75% by mass or more on the basis of the whole amount of the lubricating oil composition.

The content of the mineral base oil to be contained in the lubricating oil composition of one embodiment of the present invention is typically 50% by mass or more, preferably 55% by mass or more, more preferably 60% by mass or more, still more preferably 65% by mass or more, and yet still more preferably 70% by mass or more, and it is preferably 99.9% by mass or less, more preferably 99% by mass or less, and still more preferably 95% by mass or less, on the basis of the whole amount (100% by mass) of the lubricating oil composition.

<Olefinic Copolymer>

The olefinic copolymer to be contained in the lubricating oil composition of the present invention has a function as a viscosity index improver and is added to the lubricating oil composition for the purposes of improving the viscosity-temperature characteristic and the fuel consumption.

Now, a polymer component, such as an olefinic copolymer, a polymethacrylate, etc., that is added as the viscosity index improver, becomes a factor that generates coking as a cause of lowering the high-temperature piston detergency.

Accordingly, lubricating oil compositions having such a polymer component added thereto for the purpose of improving the viscosity-temperature characteristic and the fuel consumption involve a problem, such as a lowering of the high-temperature piston detergency.

On the other hand, in the lubricating oil composition of the present invention, it is contemplated to solve the foregoing problem by using the mineral base oil satisfying the requirements (I) to (III) (particularly, the requirement (III)) and containing, as the viscosity index improver, the olefinic copolymer.

Namely, the lubricating oil composition of the present invention uses, as the base oil, the mineral base oil satisfying the requirement (III), and therefore, even when coking is generated from the viscosity index improver, the desirable high-temperature piston detergency can be maintained.

In the lubricating oil composition of the present invention, in the olefinic copolymer to be used as the viscosity index improver, coking to be caused due to the presence of the olefinic copolymer is hardly deposited when used in combination with the mineral base oil.

Accordingly, the lubricating oil composition of the present invention may be improved in viscosity-temperature characteristic and fuel consumption to have desirable high-temperature piston detergency.

The olefinic copolymer to be used in one embodiment of the present invention is a copolymer having a structural unit derived from a monomer having an alkenyl group, and examples thereof include copolymers of an α-olefin having a carbon number of 2 to 20 (preferably 2 to 16, and more preferably 2 to 14). Among these, an ethylene-α-olefin copolymer composed of ethylene and an α-olefin having a carbon number of 3 to 20 is preferred, and an ethylene-propylene copolymer is more preferred.

Though, the carbon number of the α-olefin constituting the ethylene-α-olefin copolymer is preferably 3 to 20, and it is more preferably 3 to 16, still more preferably 3 to 14, and yet still more preferably 3 to 6.

The olefinic copolymer to be used in one embodiment of the present invention may be either a non-dispersive olefinic copolymer or a dispersive olefinic copolymer.

Examples of the dispersive olefinic copolymer include copolymers resulting from graft polymerization of the aforementioned ethylene-α-olefin copolymer with maleic acid, N-vinylpyrrolidone, N-vinyl imidazole, glycidyl acrylate, or the like.

The olefinic copolymer to be used in one embodiment of the present invention may be a copolymer having only a structural unit derived from an aliphatic hydrocarbon, or it may also be a copolymer in which an aromatic hydrocarbon group is bonded to a main chain of a copolymer having only a structural unit derived from an aliphatic hydrocarbon.

Examples of the copolymer in which an aromatic hydrocarbon group is bonded to a main chain of a copolymer having only a structural unit derived from an aliphatic hydrocarbon include styrene-based copolymers (for example, a styrene-diene copolymer, a styrene-isoprene copolymer, etc.).

From the viewpoint of producing a lubricating oil composition having improved viscosity-temperature characteristic and fuel consumption, a weight-average molecular weight (Mw) of the olefinic copolymer to be used in one embodiment of the present invention is preferably 10,000 to 1,000,000, more preferably 50,000 to 800,000, still more preferably 100,000 to 700,000, and yet still more preferably 200,000 to 600,000.

In the lubricating oil composition of one embodiment of the present invention, the content of the olefinic copolymer is preferably 0.01 to 15.0% by mass, more preferably 0.1 to 10.0% by mass, still more preferably 0.5 to 6.0% by mass, and yet still more preferably 1.0 to 4.0% by mass on the basis of the whole amount (100% by mass) of the lubricating oil composition.

Though there is a case where the olefinic copolymer is used in a solution form of being dissolved in a diluent oil, the aforementioned "content of the olefinic copolymer" refers to a solids content of the olefinic copolymer, from which the mass of the diluent oil has been excluded. The "content of the polymer component" as described later is also the same.

<Polymer Component Other than Olefinic Copolymer>

In the lubricating oil composition of one embodiment of the present invention, a polymer component other than the olefinic copolymer may be contained within a range where the effects of the present invention are not impaired.

The aforementioned "polymer component" means a compound that is a component becoming a factor that generates coking, and that has a weight-average molecular weight (Mw) of 1,000 or more and has at least one repeating unit, and examples thereof include components to be added as a viscosity index improver or a pour-point depressant, that are an additive for a lubricating oil. Accordingly, the aforementioned mineral base oil or synthetic oil is not corresponding to the "polymer component" as referred to herein.

Examples of the polymer component to be used as the viscosity index improver include polymethacrylates (e.g., a non-dispersive polymethacrylate or a dispersive polymethacrylate) and the like.

Examples of the polymer component to be used as the pour-point depressant that is the additive for a lubricating oil include an ethylene-vinyl acetate copolymer, a condensation product of a chlorinated paraffin and naphthalene, a condensation product of a chlorinated paraffin and phenol, a polymethacrylate, a polyalkylstyrene, and the like.

In the lubricating oil composition of one embodiment of the present invention, from the viewpoint of producing a lubricating oil composition having desirable high-temperature piston detergency, the content of the polymer component other than the olefinic copolymer is preferably less than 80 parts by mass, more preferably less than 70 parts by mass, still more preferably less than 60 parts by mass, and yet still more preferably less than 50 parts by mass based on 100 parts by mass of the whole amount of the olefinic copolymer to be contained in the lubricating oil composition.

Now, the polymethacrylate to be used as the viscosity index improver or pour-point depressant is liable to become a factor that generates coking among the polymer components.

In particular, a polymethacrylate (α) having a weight-average molecular weight of 200.000 or more, that is frequently used as the viscosity index improver, is a component that is generally liable to generate coking, and preferably, its content is small as far as possible.

However, in the lubricating oil composition of the present invention, the mineral base oil satisfying the requirement (III) is used, and therefore, so long as the polymethacrylate (α) is used in a small amount, the generation of coking is inhibited, so that the desirable high-temperature piston detergency can be maintained.

In the lubricating oil composition of one embodiment of the present invention, the content of the polymethacrylate (α) is preferably less than 60 parts by mass, more preferably less than 50 parts by mass, and still more preferably less than 45 parts by mass based on 100 parts by mass of the whole amount of the olefinic copolymer to be contained in the lubricating oil composition.

When the content of the polymethacrylate (α) is less than 60 parts by mass, the generation of coking is inhibited, so that the desirable high-temperature piston detergency can be maintained.

With respect to a polymethacrylate (β) having a weight-average molecular weight of less than 200,000, that is frequently used as the pour-point depressant, its content is preferably adjusted from the viewpoint of maintaining the desirable high-temperature piston detergency.

In the lubricating oil composition of one embodiment of the present invention, from the viewpoint of maintaining the desirable high-temperature piston detergency, the content of the polymethacrylate (β) is preferably 80 parts by mass or less, more preferably 70 parts by mass or less, still more preferably 60 parts by mass or less, and yet still more preferably 50 parts by mass or less, based on 100 parts by mass of the whole amount of the olefinic copolymer, and from the viewpoint of making the low-temperature fluidity more desirable, the content of the polymethacrylate (β) is preferably 0.5 parts by mass or more, more preferably 0.7 parts by mass or more, and still more preferably 1.0 part by mass or more.

<Additive for Lubricating Oil>

The lubricating oil composition of the present invention may further contain an additive for a lubricating oil other than the aforementioned viscosity index improver and pour-point depressant, which is generally used, as required, within a range where the effects of the present invention are not impaired.

Examples of such an additive for a lubricating oil include a metal-based detergent, a dispersant, an anti-wear agent, an extreme pressure agent, an antioxidant, an anti-foaming agent, a friction adjuster, a rust inhibitor, a metal deactivator, and the like.

The additive for a lubricating oil may also be a commercially available API/ILSAC SN/GF-5-certified additive package containing a plurality of additives.

A compound having plural functions as the additive (for example, a compound having functions as an anti-wear agent and an extreme pressure agent) may also be used.

Furthermore, the respective additives for a lubricating oil may be used either alone or in combination of two or more thereof.

Though the content of each of such additives for a lubricating oil can be appropriately adjusted within a range where the effects of the present invention are not impaired, it is typically 0.001 to 15% by mass, preferably 0.005 to 10% by mass, and more preferably 0.01 to 8% by mass on the basis of the whole amount (100% by mass) of the lubricating oil composition.

In the lubricating oil composition of one embodiment of the present invention, a total content of these additives for a lubricating oil is preferably 0 to 30% by mass, more preferably 0 to 25% by mass, still more preferably 0 to 20% by mass, and yet still more preferably 0 to 15% by mass on the basis of the whole amount (100% by mass) of the lubricating oil composition.

(Metal-Based Detergent)

Examples of the metal-based detergent include organic acid metal salt compounds containing a metal atom selected from an alkali metal and an alkaline earth metal, and specifically, examples thereof include a metal salicylate, a metal phenate, and a metal sulfonate, each containing a metal atom selected from alkali metals and alkali earth metals, and the like.

In this specification, the "alkali metal" refers to lithium, sodium, potassium, rubidium, cesium, or francium.

The "alkaline earth metal" refers to beryllium, magnesium, calcium, strontium, or barium.

From the viewpoint of improving the high-temperature detergency, the metal atom to be contained in the metal-based detergent is preferably sodium, calcium, magnesium, or barium, and more preferably calcium.

The metal salicylate is preferably a compound represented by the following general formula (1); the metal phenate is preferably a compound represented by the following general formula (2); and the metal sulfonate is preferably a compound represented by the following general formula (3).

(1)

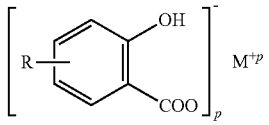

(2)

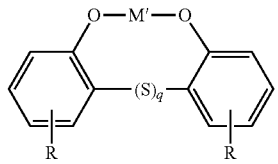

(3)

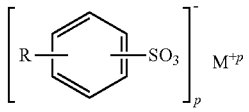

In the general formulae (1) to (3), M is a metal atom selected from an alkali metal and an alkaline earth metal, preferably sodium, calcium, magnesium, or barium, and more preferably calcium; M' is an alkaline earth meta, preferably calcium, magnesium, or barium, and more preferably calcium; p is a valence for M, and is 1 or 2; R is a hydrogen atom or a hydrocarbon group having a carbon number of 1 to 18; and q is an integer of 0 or more, and preferably an integer of 0 to 3.

Examples of the hydrocarbon group that can be selected for R include an alkyl group having a carbon number of 1 to 18, an alkenyl group having a carbon number of 1 to 18, a cycloalkyl group having ring carbon atoms of 3 to 18, an aryl group having ring carbon atoms of 6 to 18, an alkylaryl group having a carbon number of 7 to 18, an arylalkyl group having a carbon number of 7 to 18, and the like.

In one embodiment of the present invention, these metal-based detergents may be used either alone or in combination of two or more thereof.

Among these, from the viewpoints of an improvement in the high-temperature detergency and solubility in the base oil, the metal-based detergent is preferably at least one selected from calcium salicylate, calcium phenate, and calcium sulfonate.

In one embodiment of the present invention, the metal-based detergent may be any of a neutral salt, a basic salt, an overbased salt, and a mixture thereof.

A total base number of the metal-based detergent is preferably 0 to 600 mgKOH/g.

In one embodiment of the present invention, in the case where the metal-based detergent is a basic salt or an overbased salt, the total base number of the metallic detergency is preferably 10 to 600 mgKOH/g, and more preferably 20 to 500 mgKOH/g.

In this specification, the "base number" means a base number measured by the perchloric acid method in conformity with Item 7 of the "Petroleum Product and Lubricant-Neutralization Number Test Method" of JIS K2601.

(Dispersant)

Examples of the dispersant include a succinimide, benzylamine, a succinic acid ester, and a boron-modified product thereof, and the like.

Examples of the succinimide include monoimides or bisimides of a succinic acid having a polyalkenyl group, such as a polybutenyl group, etc., having a number average molecular weight of 300 to 4,000, and a polyethylenepolyamine, such as ethylenediamine, diethylenetriamine, triethylenetetramine, tetraethylenepentamine, pentaethylenehexamine, etc., or boron-modified products thereof; Mannich reaction products of a phenol having a polyalkenyl group, formaldehyde, and polyethylenepolyamine; and the like.

(Anti-Wear Agent)

Examples of the anti-wear agent include sulfur-containing compounds, such as a zinc dialkyl dithiophosphate (ZnDTP), zinc phosphate, zinc dithiocarbamate, molybdenum dithiocarbamate, molybdenum dithiophosphate, a disulfide, a sulfurized olefin, a sulfurized oil, a sulfurized ester, a thiocarbonate, a thiocarbamate, a polysulfide, etc.; phosphorus-containing compounds, such as a phosphorous acid ester, a phosphoric acid ester, a phosphonic acid ester, and an amine salt or metal salt thereof, etc.; and sulfur- and phosphorus-containing anti-wear agents, such as a thiophosphorous acid ester, a thiophosphoric acid ester, a thiophosphonic acid ester, and an amine salt or metal salt thereof, etc.

Among these, a zinc dialkyl dithiophosphate (ZnDTP) is preferred, and a combination of a primary alkyl-type zinc dialkyl dithiophosphate and a secondary alkyl-type zinc dialkyl dithiophosphate is more preferred.

(Extreme Pressure Agent)

Examples of the extreme pressure agent include sulfur-based extreme pressure agents, such as a sulfide, a sulfoxide, a sulfone, a thiophosphinate, etc.; halogen-based extreme pressure agents, such as a chlorinated hydrocarbon, etc.; and organometallic extreme pressure agents; and the like. In addition, among the aforementioned anti-wear agents, the compounds having a function as the extreme pressure agent can also be used.

In one embodiment of the present invention, these extreme pressure agents may be used either alone or in combination of two or more thereof.

(Antioxidant)

As the antioxidant, an arbitrary compound can be appropriately selected and used among any known antioxidants which are conventionally used as the antioxidant for lubricating oils. Examples thereof include an amine-based antioxidant, a phenol-based antioxidant, a molybdenum-based antioxidant, a sulfur-based antioxidant, a phosphorus-based antioxidant, and the like.

Examples of the amine-based antioxidant include diphenylamine-based antioxidants, such as diphenylamine, an alkylated diphenylamine having an alkyl group having a carbon number of 3 to 20, etc.; naphthylamine-based antioxidants, such as α-naphthylamine, phenyl-α-naphthylamine, a substituted phenyl-α-naphthylamine having an alkyl group having a carbon number of 3 to 20, etc.; and the like.

Examples of the phenol-based antioxidant include monophenol-based antioxidants, such as 2,6-di-tert-butylphenol, 2,6-di-tert-butyl-4-methylphenol, 2,6-di-tert-butyl-4-ethylphenol, isooctyl-3-(3,5-di-tert-butyl-4-hydroxyphenyl) propionate, octadecyl-3-(3,5-di-tert-butyl-4-hydroxyphenyl)propionate, etc. diphenol-based antioxidants, such as 4,4'-methylenebis(2,6-di-tert-butylphenol), 2,2'-methylenebis(4-ethyl-6-tert-butylphenol), etc.; hindered phenol-based antioxidants; and the like.

Examples of the molybdenum-based antioxidant include molybdenum amine complexes resulting from a reaction of molybdenum trioxide and/or molybdic acid with an amine compound; and the like.

Examples of the sulfur-based antioxidant include dilauryl-3,3'-thiodipropionate and the like.

Examples of the phosphorus-based antioxidant include a phosphite and the like.

In one embodiment of the present invention, though these antioxidants may be used either alone or in a combination of two or more thereof, a combination of two or more thereof is preferably used.

(Anti-Foaming Agent)

Examples of the anti-foaming agent include a silicone oil, a fluorosilicone oil, a fluoroalkyl ether, and the like.

(Friction Adjuster)

Examples of the friction adjuster include molybdenum-based friction adjusters, such as molybdenum dithiocarbamate (MoDTC), molybdenum dithiophosphate (MoDTP), an amine salt of molybdic acid, etc.; ash-free friction adjusters, such as an aliphatic amine, a fatty acid ester, a fatty acid amide, a fatty acid, an aliphatic alcohol, and an aliphatic ether, each having at least one alkyl group or alkenyl group having a carbon number of 6 to 30 in a molecule thereof, etc.; oils and fats; amines; amides; sulfurized esters; phosphoric acid esters; phosphorous acid esters; phosphoric acid ester amine salts; and the like.

(Rust Inhibitor)

Examples of the rust inhibitor include a fatty acid, an alkenyl succinic acid half ester, a fatty acid soap, an alkyl sulfonic acid salt, a polyhydric alcohol fatty acid ester, a fatty acid amine, an oxidized paraffin, an alkylpolyoxyethylene ether, and the like.

(Metal Deactivator)

Examples of the metal deactivators include a benzotriazole-based compound, a tolyltriazole-based compound, a thiadiazole-based compound, an imidazole-based compound, a pyrimidine-based compound, and the like.

In one embodiment of the present invention, these metal deactivators may be used either alone or in combination of two or more thereof.

(Production Method of Lubricating Oil Composition)

Though the method for producing the lubricating oil composition of the present invention is not particularly limited, the method for producing the lubricating oil composition containing various additives including the aforementioned olefinic copolymer is preferably a method having a process of mixing the various additives including the olefinic copolymer with the mineral base oil. On this occasion, the mineral based oil may be mixed with a synthetic oil, as required.

In the aforementioned process, the preferred compounds for the various additives to be mixed and the content of each component are those as described above.

Preferably, after a base oil obtained by mixing the mineral base oil with a synthetic oil, as required is mixed with the various additives including the olefinic copolymer, the resultant is agitated to uniformly disperse the various additives including the olefinic copolymer in the base oil according to a known method.

From the viewpoint of uniformly dispersing the various additives, it is more preferred that after rising a temperature of the base oil containing the mineral base oil to 40 to 70°

C., the various additives including the olefinic copolymer are mixed, and the resultant is agitated and uniformly dispersed.

After mixing the various additives including the olefinic copolymer with the base oil containing the mineral base oil, even when the base oil containing the mineral base oil or a part of the various additives including the olefinic copolymer denatures, or the two components react with each other to form another component, the obtained lubricating oil composition is corresponding to the lubricating oil composition obtained by the production method of the lubricating oil composition of the present invention and falls within the technical scope of the present invention.

<Various Physical Properties of Lubricating Oil Composition>

A kinematic viscosity at 100° C. of the lubricating oil composition of one embodiment of the present invention is preferably 4 $mm^2/s$ or more, more preferably 5 $mm^2/s$ or more, still more preferably 6 $mm^2/s$ or more, and yet still more preferably 7 $mm^2/s$ or more, and it is preferably less than 15 $mm^2/s$, more preferably less than 12.5 $mm^2/s$, still more preferably less than 11 $mm^2/s$, and yet still more preferably less than 10 $mm^2/s$.

A viscosity index of the lubricating oil composition of one embodiment of the present invention is preferably 140 or more, more preferably 150 or more, still more preferably 160 or more, and yet still more preferably 165 or more.

The temperature gradient $\Delta|\eta^*|$ of complex viscosity between two temperature points −10° C. and −25° C. as similarly prescribed by the requirement (III) of the lubricating oil composition of one embodiment of the present invention is preferably 60 Pa·s/° C. or less, more preferably 20 Pa·s/° C. or less, still more preferably 15 Pa·s/° C. or less, yet still more preferably 10 Pas/° C. or less, and especially preferably 5 Pa·s/C or less.

In the lubricating oil composition of one embodiment of the present invention, though a lower limit value of the temperature gradient $\Delta|\eta^*|$ of complex viscosity as similarly prescribed by the requirement (II) is not particularly limited, it is preferably 0.001 Pa·s/C or more, and more preferably 0.01 Pa·s/° C. or more.

The complex viscosity $\eta^*$ at −35° C. as similarly prescribed by the requirement (IV) for the lubricating oil composition of one embodiment of the present invention is preferably 45,000 Pa·s or less, more preferably 35,000 Pa·s or less, still more preferably 6,000 Pa·s or less, yet still more preferably 2,000 Pa·s or less, and especially preferably 500 Pa·s or less.

In the lubricating oil composition of one embodiment of the present invention, though a lower limit value of the complex viscosity $\eta^*$ at −35° C. as similarly prescribed by the requirement (IV) is not particularly limited, it is preferably 0.1 Pas/PC or more, more preferably 1 Pa·s/° C. or more, and still more preferably 2 Pas/° C. or more.

From the viewpoint of producing a lubricating oil composition having desirable low-temperature viscosity characteristics, a CCS viscosity (low-temperature viscosity) at −35° C. of the lubricating oil composition of one embodiment of the present invention is preferably 9,000 mPa·s or less, more preferably 8,600 mPa·s or less, still more preferably 7,500 mPa·s or less, and yet still more preferably 7,000 mPa·s or less.

An HTHS viscosity (high-temperature high-shear viscosity) at 150° C. of the lubricating oil composition of one embodiment of the present invention is preferably 1.4 mPa·s or more and less than 3.5 mPa·s, more preferably 1.6 mPa·s or more and less than 3.2 mPa·s, still more preferably 1.7 mPa·s or more and less than 3.0 mPa·s, and yet still more preferably 2.0 mPa·s or more and less than 2.8 mPa·s.

When the HTHS viscosity at 150° C. is 1.4 mPa·s or more, a lubricating oil composition with a desirable lubrication performance can be obtained. On the other hand, where the HTHS viscosity at 150° C. is less than 3.5 mPa·s, deterioration of the low-temperature viscosity characteristics can be reduced, and a lubricating oil composition with a desirable fuel saving performance can be produced.

The HTHS viscosity at 150° C. can also be thought of as a viscosity in a high-temperature region of an engine operating at high speed. Namely, when the HTHS viscosity at 150° C. of the lubricating oil composition falls within the aforementioned range, it may be said that the lubricating oil composition have desirable various properties, such as the viscosity that is thought of as a viscosity in a high-temperature region of an engine operating at high speed, etc.

The HTHS viscosity at 160° C. of the lubricating oil composition means a value measured in conformity with ASTM D4741, and in more detail, a value measured by the method described in the section of Examples as described later.

In one embodiment of the present invention, a lubricating oil composition having not only a kinematic viscosity at 100° C. of less than 12.5 mms/s but also an HTHS viscosity at 150° C. of less than 3.5 mPa·s is preferred.

In view of satisfying the aforementioned requirements, the lubricating oil composition can reduce the fluid friction and improve the fuel saving performance.

A density at 15° C. of the lubricating oil composition of one embodiment of the present invention is preferably 0.80 to 0.90 g/cm, and more preferably 0.82 to 0.87 g/cm.

The density at 15° C. of the lubricating oil composition means a value measured in conformity with JIS K2249: 2011.

In the lubricating oil composition of one embodiment of the present invention, a deposit amount measured in a panel coking test conducted under the conditions described in the section of Examples is preferably less than 100 mg, more preferably less than 90 mg, still more preferably less than 85 mg, and yet still more preferably less than 80 mg.

<Use of Lubricating Oil Composition>

The lubricating oil composition of the present invention has desirable low-temperature viscosity characteristics, including low-temperature fuel consumption and low-temperature engine start-up performance, and even when mixed with a polymer component as an additive, it has an excellent effect in reducing a high-temperature piston detergency drop to be caused due to the polymer component.

Accordingly, examples of engines filled with the lubricating oil composition of the present invention include engines for vehicles, such as automobiles, electric trains, aircraft, etc. Preferred are automobile engines, and more preferred are automobile engines equipped with a hybrid mechanism or a start-up system.

The lubricating oil composition of one embodiment of the present invention is suitable for uses as a lubricating oil composition for internal combustion engines of vehicles, such as automobiles, electric trains, aircraft, etc. (engine oils for internal combustion engines), and is also applicable for other uses.

Examples of the other possible use of the lubricating oil composition of one embodiment of the present invention include power steering oils, automatic transmission fluids (ATF), continuously variable transmission fluids (CVTF), hydraulic actuation oils, turbine oils, compressor oils, lubricants for machine tools, cutting oils, gear oils, fluid dynamic bearing oils, roller bearing oils, and the like.

The lubricating oil composition of the present invention is suited for lubrication for a sliding mechanism equipped with a piston ring and a liner in a device having a sliding mechanism having a piston ring and a liner, particularly a sliding mechanism equipped with a piston ring and a liner in an internal combustion engine (preferably, an internal combustion engine of automobile).

A material for forming the piston ring or cylinder liners to which the lubricating oil composition of the present invention is applied is not particularly limited. Examples of a cylinder liner-forming material include an aluminum alloy, a cast iron alloy, and the like.

Examples of a piston ring-forming material include a Si—Cr steel, a martensite-based stainless steel containing 11 to 17% by mass of Cr, and the like. Preferably, the piston ring-forming material is subjected to a substrate treatment according to a chromium plating treatment, a chromium nitride treatment, a nitriding treatment, or a combination thereof.

[Internal Combustion Engine]

The present invention also provides an internal combustion engine having a sliding mechanism equipped with a piston ring and a liner and including the aforementioned lubricating oil composition of the present invention.

In one embodiment of the present invention, an internal combustion engine in which the lubricating oil composition of the present invention is applied to a sliding portion of the aforementioned sliding mechanism is preferred.

The lubricating oil composition of the present embodiment and the sliding mechanism equipped with a piston ring and a liner are those as described above, and as a specific configuration of the sliding mechanism, there is exemplified one shown in FIG. 2.

A sliding mechanism 1 shown in FIG. 2 includes a block 2 having a piston travel path 2*a* and a crank shaft housing 2*b*, a liner 12 disposed along the inner wall of the piston travel path 2*a*, a piston 4 housed inside the liner 12, piston rings 6 fitted around the piston 4, a crank shaft 10 housed inside the crank shaft housing 2*b*, a con'rod 9 that connects the crank shaft 10 to the piston 4, and a structure interposed between the liner 12 and the piston travel path 2*a*.

The crank shaft 10 is rotatably driven by a non-illustrated motor and enables the piston 4 to make a reciprocating motion via the con'rod 9.

In the sliding mechanism 1 of such a configuration, a lubricating oil composition 20 of the present invention is charged into the crank shaft housing 2*b* until the liquid level is above the center of the central axis of the crank shaft 10 and below the uppermost end of the central axis. The lubricating oil composition 20 in the crank shaft housing 2*b* is supplied between the liner 12 and the piston rings 6 by being splashed with the rotating crank shaft 10.

[Lubrication Method of Internal Combustion Engine]

The present invention also provides a lubrication method of an internal combustion engine for lubricating a device having a sliding mechanism equipped with a piston ring and a liner, the method including lubricating the piston ring and the liner with the aforementioned lubricating oil composition of the present invention.

The lubricating oil composition of the present embodiment and the sliding mechanism equipped with a piston ring and a liner are those as described above.

In the lubrication method of an internal combustion engine of the present invention, by using the lubricating oil composition of the present embodiment as a lubricating oil for the sliding portion between the piston ring and the cylinder liner, the friction is greatly reduced in both fluid lubrication and mixed lubrication, thereby enabling one to contribute to an improvement of the fuel consumption.

EXAMPLES

The present invention is hereunder described in more detail by reference to Examples, but it should be construed that the present invention is by no means limited by the following Examples. The measurement methods and evaluation methods of various physical properties are as follows.

<Measurement Methods of Various Physical Properties of Mineral Base Oil or Lubricating Oil Composition>

(1) Kinematic Viscosities at 40° C. and 100° C.

Kinematic viscosities were measured in conformity with JIS K2283:2000.

(2) Viscosity Index

Viscosity index was measured in conformity with JIS K2283:2000.

(3) CCS Viscosity $\eta^*$ at −35°

CCS viscosity was measured in conformity with JIS K2010:1993 (ASTM D 2602).

(4) Complex Viscosities $\eta^*$ at −25° C., −10° C., and −36° C.

Complex viscosities $\eta^*$ were measured with a rheometer, "Physica MCR 301", manufactured by Anton Paar according to the following procedures.

First of all, a mineral base oil or a lubricating oil composition to be measured was inserted in a cone plate (diameter: 60 mm, tilt angle: 1°) that had been adjusted to a measurement temperature of −25° C., −10° C., or −35° C. and then held at the same temperature for 10 minutes. On this occasion, care was taken so as not to induce a strain in the inserted solution.

The complex viscosity $\eta^*$ was then measured at the predetermined measurement temperatures in a vibration mode at an angular velocity of 6.3 rad/s and a strain amount ranging from 0.1 to 100% which was appropriately selected according to the measurement temperature. In the measurement of the complex viscosity $\eta^*$ at −35° C., the strain amount was set to "0.1%".

The "temperature gradient $\Delta|\eta^*|$ of complex viscosity" was then calculated from the values of complex viscosity $\eta^*$ at −25° C. and −10° C. according to the aforementioned calculation formula (f1).

(5) Weight-Average Molecular Weight (Mw) and Number Average Molecular Weight (Mn)

These were measured with a gel permeation chromatography device ("1260 Type HPLC", manufactured by Agilent) under the following conditions, and the values measured as expressed in terms of a standard polystyrene conversion were adopted.

(Measurement Conditions)

Column: Two "Shodex LF404" columns connected in series

Column temperature: 35° C.

Developing solvent: Chloroform

Flow rate: 0.3 mL/min

<Measurement Methods of Various Physical Properties of Mineral Base Oil>

(6) Aromatic Content (% $C_A$) and Naphthene Content (% $C_N$)

These were measured according to the ASTM D-3238 ring analysis (n-d-M method).

(7) Sulfur Content

Sulfur content was measured in conformity with JIS K2541-6:2003.

(8) Nitrogen Content

Nitrogen content was measured in conformity with JIS K2609:1998 4.

<Measurement Methods of Various Physical Properties of Lubricating Oil Composition>

(9) HTHS Viscosity (High-Temperature High-Shear Viscosity) at 150° C.

A lubricating oil composition to be measured was sheared at a shear rate of $10^6$/s at 150° C., and the viscosity after shearing was measured in conformity with ASTM D4741.

The "bottom oil" and the "slack wax" used in each of the Examples and Comparative Examples were produced as follows.

Production Example 1 (Production of Bottom Oil)

A bottom fraction remained after hydrocracking of an oil containing a heavy fuel oil obtained from a vacuum distillation unit in a common fuel oil producing process, followed by separation and removal of naphtha and a kerosene-gas oil was extracted. The foregoing bottom fraction was used as the "bottom oil" in the following production.

The bottom oil had an oil content of 75% by mass, a sulfur content of 82 ppm by mass, a nitrogen content of 2 ppm by mass, a kinematic viscosity 100° C. of 4.1 mms/s, and a viscosity index of 134.

Production Example 2 (Production of Solvent Dewaxed Oil and Slack Wax)

The bottom oil obtained as described above was dewaxed with a mixed solvent of methyl ethyl ketone and toluene in a low-temperature region of from −35° C. to −30° C. to separate the wax, thereby obtaining the "solvent dewaxed oil". The separated wax was used as a slack wax.

The solvent dewaxed oil had an oil content of 100% by mass, a sulfur content of 70 ppm by mass, a nitrogen content of 2 ppm by mass, a kinematic viscosity at 100° C. of 4.1 mms/s, and a viscosity index of 121.

The slack wax had an oil content of 15% by mass, a sulfur content of 12 ppm by mass, a nitrogen content of less than 1 ppm by mass, a kinematic viscosity at 100° C. of 4.2 $mm^2$/s, and a viscosity index of 169.

Example 1 (Production of Mineral Base Oil (1))

The solvent dewaxed oil obtained in Production Example 2 was used as a feedstock oil (i).

The feedstock oil (i) was subjected to a hydrogenation process under conditions at a hydrogen partial pressure of 20 MPa, a reaction temperature of 280 to 320° C., and an LHSV of 1.0 $hr^{-1}$, by using a nickel tungsten-based catalyst.

The generated oil after the hydrogenation process was vacuum distillated, and a fraction having a kinematic viscosity at 100° C. ranging from 4.2 to 4.4 $mm^2$/s was collected to obtain a mineral base oil (1).

The mineral base oil (1) had an aromatic content (% $C_A$) of 0.0, a naphthene content (% $C_N$) of 26.5, a sulfur content of less than 100 ppm by mass, and a weight average molecular weight of 150 to 450.

Example 2 (Production of Mineral Base Oil (2))

A mixture of 75 parts by mass of the slack wax obtained in Production Example 2 and 25 parts by mass of the bottom oil obtained in Production Example 1 was used as a feedstock oil (ii). The feedstock oil (ii) had an oil content of 30% by mass, a sulfur content of 30 ppm by mass, a nitrogen content of less than 1 ppm by mass, a kinematic viscosity at 100° C. of 4.2 $mm^2$/s, and a viscosity index of 160.

The feedstock oil (ii) was subjected to hydrogenation isomerization dewaxing under conditions at a hydrogen partial pressure of 4 MPa, a reaction temperature of 335° C., and an LHSV of 1.0 $hr^{-1}$, by using a hydrogenation isomerization dewaxing catalyst.

Subsequently, the generated oil after the hydrogenation isomerization dewaxing was subjected to a hydrogenation process under conditions at a hydrogen partial pressure of 20 MPa, a reaction temperature of 280 to 320° C., and an LHSV of 1.0 $hr^{-1}$, by using a nickel tungsten-based catalyst.

The generated oil after the hydrogenation process was vacuum distillated, and a fraction having a kinematic viscosity at 100° C. ranging from 4.2 to 4.4 $mm^2$/s was collected to obtain a mineral base oil (2).

The mineral base oil (2) had an aromatic content (% $C_A$) of 0.0, a naphthene content (% $C_N$) of 18.3, a sulfur content of less than 100 ppm by mass, and a weight average molecular weight of 150 to 450.

Example 3 (Production of Mineral Base Oil (3))

A mixture of 90 parts by mass of the slack wax obtained in Production Example 2 and 10 parts by mass of the bottom oil obtained in Production Example 1 was used as a feedstock oil (iii). The feedstock oil (iii) had an oil content of 21% by mass, a sulfur content of 19 ppm by mass, a nitrogen content of less than 1 ppm by mass, a kinematic viscosity at 100° C. of 4.2 $mm^2$/s, and a viscosity index of 166.

The feedstock oil (iii) was subjected to hydrogenation isomerization dewaxing under conditions at a hydrogen partial pressure of 4 MPa, a reaction temperature of 340° C., and an LHSV of 0.5 $hr^{-1}$, by using a hydrogenation isomerization dewaxing catalyst.

Subsequently, the generated oil after the hydrogenation isomerization dewaxing was subjected to a hydrogenation process under conditions at a hydrogen partial pressure of 20 MPa, a reaction temperature of 280 to 320° C., and an LHSV of 1.0 $hr^{-1}$, by using a nickel tungsten-based catalyst.

The generated oil after the hydrogenation process was vacuum distillated, and a fraction having a kinematic viscosity at 100° C. ranging from 4.2 to 4.4 $mm^2$/s was collected to obtain a mineral base oil (3).

The mineral base oil (3) had an aromatic content (% $C_A$) of 0.0, a naphthene content (% $C_N$) of 16.7, a sulfur content of less than 100 ppm by mass, and a weight average molecular weight of 150 to 450.

Example 4 (Production of Mineral Base Oil (4))

A mineral base oil (4) was obtained in the same method as in Example 2, except that the generated oil after the hydrogenation process in the production method of Example 2 was vacuum distillated, and that a fraction having a kinematic viscosity at 100° C. ranging from 2.5 to 3.0 $mm^2$/s was collected.

The mineral base oil (4) had an aromatic content (% $C_A$) of 0.1, a naphthene content (% $C_N$) of 20.2, a sulfur content of less than 100 ppm by mass, and a weight average molecular weight of 150 to 450.

Comparative Example 1 (Production of Mineral Base Oil (a))

A heavy fuel oil obtained from a vacuum distillation unit in a common fuel oil producing process was extracted with a furfural solvent under conditions at a solvent ratio of 1.0 to 2.0, thereby obtaining a raffinate.

The raffinate was subjected to hydrogenation isomerization dewaxing under conditions at a hydrogen partial pressure of 4 MPa, a reaction temperature of 260 to 280° C., and an LHSV of 1.0 $hr^{-1}$, by using a hydrogenation isomerization dewaxing catalyst.

Subsequently, the generated oil after the hydrogenation isomerization dewaxing was subjected to a hydrogenation process under conditions at a hydrogen partial pressure of 4 to 5 MPa, a reaction temperature of 280 to 320° C., and an LHSV of 1.0 $hr^{-1}$, by using a nickel tungsten-based catalyst. The generated oil after the hydrogenation process was vacuum distillated, and a fraction having a kinematic viscosity at 100° C. ranging from 4.0 to 4.5 $mm^2/s$ was collected to obtain a mineral base oil (a).

The mineral base oil (a) had an aromatic content (% $C_A$) of 2.8, a naphthene content (% $C_N$) of 27.3%, a sulfur content of 1,000 ppm by mass, and a weight average molecular weight of 150 to 450.

Comparative Example 2 (Production of Mineral Base Oil (b))

A mineral base oil (b) was obtained in the same method as in Comparative Example 1, except that the generated oil after the hydrogenation process in the production method of Comparative Example 1 was vacuum distillated, and that a fraction having a kinematic viscosity at 100° C. ranging from 2.0 to 3.0 $mm^2/s$ was collected.

The mineral base oil (b) had an aromatic content (% $C_A$) of 4.7, a naphthene content (% $C_N$) of 28.7, a sulfur content of 2,000 ppm by mass, and a weight average molecular weight of 150 to 450.

Comparative Example 3 (Production of Mineral Base Oil (c))

A mixture of 20 parts by mass of the slack wax obtained in Production Example 2 and 80 parts by mass of the bottom oil obtained in Production Example 1 was used as a feedstock oil (iv). The feedstock oil (iv) had an oil content of 62.5% by mass, a sulfur content of 68 ppm by mass, a nitrogen content of 2 ppm by mass, a kinematic viscosity at 100° C. of 4.1 $mm^8/s$, and a viscosity index of 141.

A mineral base oil (c) was obtained in the same method as in Example 2, except that the feedstock oil (iv) was used as a feedstock oil in place of the feedstock oil (ii) used in the production method of Example 2, and that the generated oil after the hydrogenation process was vacuum distillated, and a fraction having a kinematic viscosity at 100° C. ranging from 6.0 to 7.0 $mm^2/s$ was collected.

The mineral base oil (c) had an aromatic content (% $C_A$) of 0.0, a naphthene content (% $C_N$) of 21.4, a sulfur content of less than 100 ppm by mass, and a weight average molecular weight of more than 450.

Various properties of the mineral base oils produced in the Examples and Comparative Examples are shown in Table 1. In addition, the graph that represents the relationship between temperature and complex viscosity η* with respect to the mineral base oil (2) of Example 2, the mineral base oil (a) of Comparative Example 1, and the mineral base oil (b) of Comparative Example 2 is shown in FIG. 1.

TABLE 1

| | | Example | | | | Comparative Example | | |
|---|---|---|---|---|---|---|---|---|
| Properties | Unit | 1 Mineral base oil (1) | 2 Mineral base oil (2) | 3 Mineral base oil (3) | 4 Mineral base oil (4) | 1 Mineral base oil (a) | 2 Mineral base oil (b) | 3 Mineral base oil (c) |
| Kinematic viscosity at 40° C. | $mm^2/s$ | 20.0 | 18.4 | 19.2 | 9.3 | 20.7 | 9.6 | 36.8 |
| Kinematic viscosity at 100° C. | $mm^2/s$ | 4.3 | 4.2 | 4.2 | 2.6 | 4.2 | 2.6 | 6.5 |
| Viscosity index | — | 123 | 132 | 126 | 112 | 102 | 97 | 131 |
| CCS viscosity at −35° C. | mPa · s | 3600 | 2470 | 1940 | Less than 1000 | 4800 | 1120 | 9800 |
| Temperature gradient Δ \| η* \| of complex viscosity between two temperature points −10° C. and −25° C. | Pa · s/° C. | 16.4 | 12.9 | 0.03 | 1.2 | 1623.3 | 328.6 | 62.0 |
| Complex viscosity η* at −10°C . | Pa · s | 0.194 | 0.189 | 0.181 | 0.072 | 0.259 | 0.083 | 0.381 |
| Complex viscosity η* at −25° C. | Pa · s | 245.5 | 193.4 | 0.598 | 18.03 | 24350.0 | 4929.0 | 931.0 |
| Complex viscosity η* at −35° C. | Pa · s | 38500 | 5999 | 4.4 | 184.7 | 93740 | 80540 | 90264 |
| Aromatic content (% $C_A$) | — | 0.0 | 0.0 | 0.0 | 0.1 | 2.8 | 4.7 | 0.0 |
| Naphthene content (% $C_N$) | — | 26.5 | 18.3 | 16.7 | 20.2 | 27.3 | 28.7 | 21.4 |
| Sulfur content | ppm by mass | 100> | 100> | 100> | 100> | 1000 | 2000 | 100> |

Examples 5 to 12 and Comparative Examples 4 to 9

Lubricating oil compositions (i) to (viii) and (A) to (F) were prepared, respectively by mixing the additives for a lubricating oil of the kinds and mixing amounts shown in Tables 2 and 3 with one of the mineral base oils (1) to (4) and (a) to (c) produced in the Examples and Comparative Examples of the kinds shown in Tables 2 and 3.

The details of the additives for a lubricating oil shown in Tables 2 and 3 are as follows.

OCP (1): Olefinic copolymer having an Mw of 500,000

OCP (2): Olefinic copolymer (ethylene-propylene copolymer) having an Mw of 300,000

PMA (1): Polymethacrylate having an Mw of 400,000

PMA (2): Polymethacrylate having an Mw of 500,000

Metal-based detergent (1): Overbased calcium salicylate, base number (perchloric acid method)=350 mgKOH/g, calcium atom content=12.1 mass %

Metal-based detergent (2): Overbased calcium salicylate, base number (perchloric acid method)=225 mgKOH/g, calcium atom content=7.8 mass %

Anti-wear agent (1): Primary alkyl-type zinc dialkyl dithiophosphate, zinc atom content=8.9 mass %, phosphorus atom content=7.4 mass %

Anti-wear agent (2): Secondary alkyl-type zinc dialkyl dithiophosphate, zinc atom content=9.0 mass %, phosphorus atom content=8.2 mass %

Antioxidant (1): Amine-based antioxidant

Antioxidant (2): Phenol-based antioxidant

Dispersant (1): Polybutenyl succinbisimide, Mn of the polybutenyl group=2,000, base number (perchloric acid method)=11.9 mgKOH/g, nitrogen atom content=0.99 mass %

Dispersant (2): polybutenyl succinmonoimide boride, Mn of the polybutenyl group=1,000, base number (perchloric acid method)=25 mgKOH/g, nitrogen atom content=1.23 mass %, boron atom content=1.3 mass %

Rust Inhibitor, Anti-foaming agent

Pour-point depressant: Polymethacrylate having an Mw of 69,000

The lubricating oil compositions (i) to (viii) and (A) to (F) were measured for various properties according to the measurement methods described above. These compositions were also measured for the deposit amount in a panel coking test conducted according to the method described below. The percentage increase P of the deposit amount was calculated for the lubricating oil compositions (vi) to (viii) and (E) to (F) each containing the pour-point depressant. The results are shown in Tables 2 and 3.

[Panel Coking Test]

(1) Measurement of Deposit Amount 300 mL of the prepared lubricating oil composition was charged into a heating vessel and heated to 100° C. The lubricating oil composition heated to 100° C. was splashed onto an aluminum board heated to 300° C. and installed at an upper portion of the heating vessel by using continuously rotating blades at 1,000 rpm. This operation was continuously performed for 3 hours by repeating a "cycle consisting of a blade rotation for 15 seconds and a pause for 45 seconds". After 3 hours, the mass of the deposit (deposit amount) adhered to the aluminum board was measured.

(2) Calculation of Percentage Increase P of Deposit Amount

On the basis of the deposit amount calculated in (1) above, the percentage increase P of the deposit amount (W) of each of the lubricating oil compositions (vi) to (viii) of Examples 10 to 12 each containing the pour-point depressant relative to the deposit amount ($W_0$) of the lubricating oil composition (i) of Example 5 not containing the pour-point depressant was calculated according to the following calculation formula (f2).

Calculation formula (f2): $P(\text{unit: }\%)=(W-W_0)/W_0\times 100$

The percentage increase P was similarly calculated for the deposit amount (W) of each of the lubricating oil compositions (E) to (F) of Comparative Examples 8 to 9 each containing the pour-point depressant relative to the deposit amount ($W_0$) of the lubricating oil composition (A) of Comparative Example 4 not containing the pour-point depressant according to the aforementioned calculation formula (f2).

TABLE 2

| Lubricating oil composition | | | | Example 5 (i) | 6 (ii) | 7 (iii) | 8 (iv) | 9 (v) | 10 (vi) | 11 (vii) | 12 (viii) |
|---|---|---|---|---|---|---|---|---|---|---|---|
| Composition | Mineral base oil | Mineral base oil (1) obtained in Example 1 | % by mass | 87.10 | — | — | — | — | 86.10 | 86.10 | 86.60 |
| | | Mineral base oil (2) obtained in Example 2 | | — | 87.10 | — | — | 86.60 | — | — | — |
| | | Mineral base oil (3) obtained in Example 3 | | — | — | 87.10 | — | — | — | — | — |
| | | Mineral base oil (4) obtained in Example 4 | | — | — | — | 87.10 | — | — | — | — |
| | | Mineral base oil (a) obtained in Comparative Example 1 | | — | — | — | — | — | — | — | — |
| | | Mineral base oil (b) obtained in Comparative Example 2 | | — | — | — | — | — | — | — | — |
| | | Mineral base oil (c) obtained in Comparative Example 3 | | — | — | — | — | — | — | — | — |
| | Additive for a lubricating oil | OCP (1) | % by mass | 2.50 | 2.50 | 2.50 | 2.50 | — | 2.50 | 2.50 | 2.50 |
| | | OCP (2) | | — | — | — | — | 3.00 | — | — | — |
| | | PMA (1) | | — | — | — | — | — | 1.00 | — | — |
| | | PMA (2) | | — | — | — | — | — | | — | — |
| | | Metal-based detergent (1) | | 1.20 | 1.20 | 1.20 | 1.20 | 1.20 | 1.20 | 1.20 | 1.20 |
| | | Metal-based detergent (2) | | 1.00 | 1.00 | 1.00 | 1.00 | 1.00 | 1.00 | 1.00 | 1.00 |

TABLE 2-continued

| Lubricating oil composition | | | Example 5 (i) | 6 (ii) | 7 (iii) | 8 (iv) | 9 (v) | 10 (vi) | 11 (vii) | 12 (viii) |
|---|---|---|---|---|---|---|---|---|---|---|
| | Anti-wear agent (1) | | 0.20 | 0.20 | 0.20 | 0.20 | 0.20 | 0.20 | 0.20 | 0.20 |
| | Anti-wear agent (2) | | 1.20 | 1.20 | 1.20 | 1.20 | 1.20 | 1.20 | 1.20 | 1.20 |
| | Antioxidant (1) | | 0.50 | 0.50 | 0.50 | 0.50 | 0.50 | 0.50 | 0.50 | 0.50 |
| | Antioxidant (2) | | 0.50 | 0.50 | 0.50 | 0.50 | 0.50 | 0.50 | 0.50 | 0.50 |
| | Dispersant (1) | | 4.00 | 4.00 | 4.00 | 4.00 | 4.00 | 4.00 | 4.00 | 4.00 |
| | Dispersant (2) | | 1.00 | 1.00 | 1.00 | 1.00 | 1.00 | 1.00 | 1.00 | 1.00 |
| | Rust inhibitor, Anti-foaming agent | | 0.80 | 0.80 | 0.80 | 0.80 | 0.80 | 0.80 | 0.80 | 0.80 |
| | Pour-point depressant | | — | — | — | — | — | — | 1.00 | 0.50 |
| | Total | % by mass | 100.00 | 100.00 | 100.00 | 100.00 | 100.00 | 100.00 | 100.00 | 100.00 |
| Properties of mineral base oil used | Temperature gradient Δ \| η* \| of comptex viscosity between two temperature points −10° C. and −25° C. | Pa · s/° C. | 16.4 | 12.9 | 0.03 | 1.2 | 12.9 | 16.4 | 16.4 | 16.4 |
| | Complex viscosity η* at −35° C. | Pa · s | 38500 | 5999 | 4.4 | 184.7 | 5999 | 38500 | 38500 | 38500 |
| Properties of lubricating oil composition | Kinematic viscosity at 40° C. | $mm^2/s$ | 50.2 | 48.2 | 48.8 | 26.0 | 56.6 | 55.9 | 55.5 | 52.9 |
| | Kinematic viscosity at 100° C. | $mm^2/s$ | 9.1 | 9.0 | 8.9 | 6.0 | 10.4 | 10.7 | 10.0 | 9.6 |
| | Viscosity index | — | 165 | 170 | 167 | 190 | 175 | 185 | 170 | 167 |
| | Temperature gradient Δ \| η* \| of comptex viscosity between two temperature points −10° C. and −25° C. | Pa · s/° C. | 18.9 | 15.3 | 0.05 | 1.3 | 12.2 | 3.5 | 0.7 | 0.8 |
| | Complex viscosity η* at −35° C. | Pa · s | 3440 | 4320 | 4.4 | 195.5 | 3560 | 152.0 | 52.2 | 65.3 |
| | CCS viscosity at −35° C. | mPa · s | 8400 | 7300 | 6700 | 4500 | 5900 | 8700 | 8500 | 8500 |
| | HTHS viscosity at 150° C. | mPa · s | 3.4 | 3.4 | 3.3 | 2.5 | 3.2 | 3.7 | 3.7 | 3.6 |
| | Deposit amount | mg | 78 | 75 | 74 | 81 | 80 | 89 | 83 | 81 |
| | Percentage increase P of deposit amount | % | — | — | — | — | — | 14.1 | 6.4 | 3.8 |
| | | Composition to be compared | — | — | — | — | — | (i) | (i) | (i) |

TABLE 3

| Lubricating oil composition | | | | Comparative Example 4 (A) | 5 (B) | 6 (C) | 7 (D) | 8 (E) | 9 (F) |
|---|---|---|---|---|---|---|---|---|---|
| Composition | Mineral base oil | Mineral base oil (1) obtained in Example 1 | % by mass | — | — | — | 87.60 | — | — |
| | | Mineral base oil (2) obtained in Example 2 | | — | — | — | — | — | — |
| | | Mineral base oil (3) obtained in Example 3 | | — | — | — | — | — | — |
| | | Mineral base oil (4) obtained in Example 4 | | — | — | — | — | — | — |
| | | Mineral base oil (a) obtained in Comparative Example 1 | | 87.10 | — | — | — | 86.10 | — |
| | | Mineral base oil (b) obtained in Comparative Example 2 | | — | 87.10 | — | — | — | 86.10 |
| | | Mineral base oil (c) obtained in Comparative Example 3 | | — | — | 87.10 | — | — | — |

TABLE 3-continued

| Lubricating oil composition | | | | Comparative Example 4 (A) | 5 (B) | 6 (C) | 7 (D) | 8 (E) | 9 (F) |
|---|---|---|---|---|---|---|---|---|---|
| | Additive for a lubricating oil | OCP (1) | % by mass | 2.50 | 2.50 | 2.50 | — | 2.50 | 2.50 |
| | | OCP (2) | | — | — | — | — | — | — |
| | | PMA (1) | | — | — | — | — | — | — |
| | | PMA (2) | | — | — | — | 2.00 | — | — |
| | | Metal-based detergent (1) | | 1.20 | 1.20 | 1.20 | 1.20 | 1.20 | 1.20 |
| | | Metal-based detergent (2) | | 1.00 | 1.00 | 1.00 | 1.00 | 1.00 | 1.00 |
| | | Anti-wear agent (1) | | 0.20 | 0.20 | 0.20 | 0.20 | 0.20 | 0.20 |
| | | Anti-wear agent (2) | | 1.20 | 1.20 | 1.20 | 1.20 | 1.20 | 1.20 |
| | | Antioxidant (1) | | 0.50 | 0.50 | 0.50 | 0.50 | 0.50 | 0.50 |
| | | Antioxidant (2) | | 0.50 | 0.50 | 0.50 | 0.50 | 0.50 | 0.50 |
| | | Dispersant (1) | | 4.00 | 4.00 | 4.00 | 4.00 | 4.00 | 4.00 |
| | | Dispersant (2) | | 1.00 | 1.00 | 1.00 | 1.00 | 1.00 | 1.00 |
| | | Rust inhibitor, Anti-foaming agent | | 0.80 | 0.80 | 0.80 | 0.80 | 0.80 | 0.80 |
| | | Pour-point depressant | | — | — | — | — | 1.00 | 1.00 |
| | | Total | % by mass | 100.00 | 100.00 | 100.00 | 100.00 | 100.00 | 100.00 |
| Properties of mineral base oil used | | Temperature gradient Δ \| η* \| of comptex viscosity between two temperature points −10° C. and −25° C. | Pa · s/° C. | 1623.3 | 328.6 | 62.0 | 16.4 | 1623.3 | 328.6 |
| | | Complex viscosity η* at −35° C. | Pa · s | 93740 | 80540 | 90264 | 38500 | 93740 | 80540 |
| Properties of lubricating oil composition | | Kinematic viscosity at 40° C. | $mm^2/s$ | 54.4 | 28.2 | 53.1 | 42.4 | 60.3 | 34.3 |
| | | Kinematic viscosity at 100° C. | $mm^2/s$ | 9.3 | 6.2 | 9.4 | 9.4 | 10.2 | 7.4 |
| | | Viscosity index | — | 153 | 182 | 160 | 214 | 158 | 188 |
| | | Temperature gradient Δ \| η* \| of comptex viscosity between two temperature points −10° C. and −25° C. | Pa · s/° C. | 255.8 | 65.7 | 68.0 | 2.3 | 1.9 | 0.3 |
| | | Complex viscosity η* at −35° C. | Pa · s | 57270 | 56378 | 80787 | 123.2 | 86.0 | 120.0 |
| | | CCS viscosity at −35° C. | mPa · s | 9800 | 5900 | 14600 | 8600 | 9800 | 6000 |
| | | HTHS viscosity at 150° C. | mPa · s | 3.4 | 2.5 | 3.6 | 3.1 | 3.7 | 2.9 |
| | | Deposit amount | mg | 101 | 115 | 91 | 156 | 123 | 132 |
| | | Percentage increase P of deposit amount | % | — | — | — | — | 21.8 | 14.8 |
| | | | Composition to be compared | — | — | — | — | (A) | (B) |

Table 2 revealed the results that in the lubricating oil compositions (i) to (viii) of Examples 5 to 11 using the mineral base oils (1) to (4) obtained in Examples 1 to 4 and containing the olefinic copolymer, the low-temperature viscosity characteristics are desirable, the deposit amount in the panel coking test is small, and the high-temperature piston detergency is excellent.

On the other hand, Table 3 revealed that in lubricating oil compositions (A) to (C) and (E) to (F) of Comparative Examples 4 to 6 and 8 to 9 using any one of the mineral base oils (a) to (c) obtained in Comparative Examples 1 to 3, the low-temperature viscosity characteristics are poor, the deposit amount is large, and the high-temperature piston detergency is problematical.

In addition, in the lubricating oil composition (D) of Comparative Example 7, there were revealed the results that the deposit amount is very large, and the high-temperature piston detergency is problematical.

REFERENCE SIGNS LIST

1: Sliding mechanism
2: Block
2*a*: Piston travel path
2*b*: Crank shaft housing
4: Piston
6, 8: Piston ring
9: Con'rod
10: Crank shaft
12: Liner
20: Lubricating oil composition

The invention claimed is:

1. A lubricating oil composition, comprising:

a mineral base oil having a naphthene content (% $C_N$) of from 16 to 30, obtained by refining a feedstock oil comprising a petroleum-derived wax and a bottom oil, and an olefinic copolymer, wherein the mineral oil has:

a kinematic viscosity at 100° C. of from 2 $mm^2/s$ to less than 7 $mm^2/s$;

a viscosity index of 100 or more; and a temperature gradient $\Delta|\eta^*|$ of a complex viscosity between two temperature points—10° C. and −25° C. of 60 Pa·s/° C. or less, as measured with a rotary rheometer under conditions at an angular velocity of 6.3 rad/s and a strain amount of 0.1 to 100%, wherein a content of the mineral base oil is from 70% to 95% by mass based on the total amount of the lubricating oil composition, a content of the olefinic copolymer is from 1.0 to 6.0% by mass based on the total amount of the lubricating oil composition, and the olefinic copolymer is an ethylene-propylene copolymer having a weight-average molecular weight (Mw) of 200,000 to 700,000.

2. The lubricating oil composition according to claim 1, wherein a content of a polymethacrylate (a) having a weight-average molecular weight of 200,000 or more is less than 60 parts by mass based on 100 parts by mass of the total amount of the olefinic copolymer.

3. The lubricating oil composition according to claim 1, wherein a content of a polymethacrylate (β) having a weight-average molecular weight of less than 200,000 is from 0.5 to 80 parts by mass based on 100 parts by mass of the total amount of the olefinic copolymer.

4. The lubricating oil composition according to claim 1, having a kinematic viscosity at 100° C. of from 4 $mm^2/s$ to less than 15 $mm^2/s$ and a viscosity index of 140 or more.

5. The lubricating oil composition according to claim 1, having a kinematic viscosity at 100° C. of less than 12.5 $mm^2/s$ and a high-temperature high-shear viscosity (HTHS viscosity) at 150° C. of less than 3.5 mPa·s.

6. An internal combustion engine, comprising a sliding mechanism equipped with a piston ring and a liner, and the lubricating oil composition according to claim 1.

7. A method for lubricating an internal combustion engine having a sliding mechanism equipped with a piston ring and a liner, the method comprising:

lubricating the piston ring and the liner with the lubricating oil composition according to claim 1.

8. The lubricating oil composition according to claim 1, wherein a content ratio of the petroleum-derived wax and the bottom oil in the feedstock oil is from 30/70 to 95/5.

9. The lubricating oil composition according to claim 1, wherein the refining comprises subjecting the feedstock oil to a hydrogenation isomerization dewaxing process, a hydrogenation process or a combination thereof, and optionally subjecting a resulting oil to a distillation process.

10. The lubricating oil composition according to claim 1, wherein the mineral base oil comprises a branched-chain isoparaffin.

11. The lubricating oil composition according to claim 1, wherein:

a content ratio of the petroleum-derived wax and the bottom oil in the feedstock oil is from 30/70 to 95/5; and the refining comprises subjecting the feedstock oil to a hydrogenation isomerization dewaxing process, a hydrogenation process or a combination thereof, and optionally subjecting a resulting oil to a distillation process.

12. The lubricating oil composition according to claim 1, wherein the composition does not contain a polymethacrylate.

13. The lubricating oil composition according to claim 1, wherein a complex viscosity of the mineral base oil at −35° C. is 60,000 Pa·s or less, as measured with a rotary rheometer under conditions at an angular velocity of 6.3 rad/s and a strain amount of 0.1%.

14. The lubricating oil composition according to claim 1, wherein the content of the olefinic copolymer is from 1.0 to 4.0% by mass based on the total amount of the lubricating oil composition.

* * * * *